US012168560B2

(12) United States Patent
Neagu et al.

(10) Patent No.: US 12,168,560 B2
(45) Date of Patent: Dec. 17, 2024

(54) CONTAINER HAVING A SEALED COMPARTMENT

(71) Applicant: PHILIP MORRIS PRODUCTS S.A., Neuchatel (CH)

(72) Inventors: Cristian Neagu, Epalinges (CH); Anja Kristiina Sandberg, Skivarp (SE); Steven Shainwald, Lausanne (CH); Benjamin Goffette, Randogne (CH)

(73) Assignee: Philip Morris Products S.A., Neuchatel (CH)

( * ) Notice: Subject to any disclaimer, the term of this patent is extended or adjusted under 35 U.S.C. 154(b) by 154 days.

(21) Appl. No.: 17/918,756

(22) PCT Filed: Apr. 21, 2021

(86) PCT No.: PCT/EP2021/060411
§ 371 (c)(1),
(2) Date: Oct. 13, 2022

(87) PCT Pub. No.: WO2021/214149
PCT Pub. Date: Oct. 28, 2021

(65) Prior Publication Data

US 2023/0128342 A1 Apr. 27, 2023

(30) Foreign Application Priority Data

Apr. 21, 2020 (EP) ..... 20170731

(51) Int. Cl.
*B65D 75/30* (2006.01)
*B65D 75/46* (2006.01)
(Continued)

(52) U.S. Cl.
CPC ..... *B65D 75/30* (2013.01); *B65D 75/46* (2013.01); *B65D 75/5805* (2013.01); *B65D 85/10* (2013.01)

(58) Field of Classification Search
CPC ..... B65D 75/30; B65D 75/321; B65D 75/46; B65D 75/5805; B65D 85/10; B65D 75/5888; B65D 85/1027
(Continued)

(56) References Cited

U.S. PATENT DOCUMENTS 3,419,137 A * 12/1968 Walck, III ..... B65D 75/5855 426/123
3,938,659 A * 2/1976 Wardwell ..... B65D 75/5855 53/433
(Continued)

FOREIGN PATENT DOCUMENTS

DE 2840223 3/1979
DE 102004047445 4/2006

OTHER PUBLICATIONS

International Preliminary Report on Patentability for PCT/EP2021/060411 dated Mar. 22, 2022 (13 pages).
(Continued)

*Primary Examiner* — Rafael A Ortiz
(74) *Attorney, Agent, or Firm* — Mueting Raasch Group

(57) ABSTRACT

A container for consumer goods, the container comprising a first substrate layer and a second substrate layer overlying the first substrate layer. A first portion of the first substrate layer and a first portion of the second substrate layer form a compartment region, wherein a perimeter of the compartment region is completely sealed to form a sealed compartment for containing one or more consumer goods. A second portion of the first substrate layer and a second portion of the second substrate layer form an access region directly adjacent to the compartment region. The access region comprises an unsealed area, wherein a perimeter of the access region extends around the unsealed area. The first substrate layer is attached to the second substrate layer at the perimeter of the access region. The unsealed area is separated from
(Continued)

the sealed compartment by the completely sealed perimeter of the compartment region. The container further comprises a line of weakness extending at least partially within the unsealed area of the access region. In the first substrate layer only, the container further comprising a second line of weakness in the second substrate layer only. The second line of weakness has a different shape to the first line of weakness, wherein the difference in shape between the first line of weakness and the second line of weakness defines a closure tab in the second substrate layer in the unsealed area of the access region.

12 Claims, 10 Drawing Sheets

(51) Int. Cl.
*B65D 75/58* (2006.01)
*B65D 85/10* (2006.01)

(58) Field of Classification Search
USPC ..... 206/264, 271, 538, 440, 63.3, 63.5, 69
See application file for complete search history.

(56) References Cited

U.S. PATENT DOCUMENTS

| | | | | |
|---|---|---|---|---|
| 4,228,900 | A | 10/1980 | Lambach | |
| 5,894,930 | A | 4/1999 | Faughey | |
| 6,440,508 | B1 * | 8/2002 | Tokita | B32B 27/32 426/127 |
| 6,726,364 | B2 * | 4/2004 | Perell | B65D 75/5855 383/61.1 |
| 7,306,371 | B2 * | 12/2007 | Perell | B65D 75/5855 383/61.1 |
| 8,534,446 | B2 | 9/2013 | Ludwig | |
| 2006/0023976 | A1 * | 2/2006 | Alvater | B65D 81/3266 383/200 |
| 2008/0190809 | A1 * | 8/2008 | Simon | B65D 50/06 206/532 |
| 2016/0135895 | A1 | 5/2016 | Faasee | |

OTHER PUBLICATIONS

PCT International Search Report and Written Opinion for PCT/EP2021/060411 dated Jun. 15, 2021 (12 pages).
Extended European Patent Application No. 20170731.2 dated Oct. 5, 2020 (8 pages).

* cited by examiner

CONTAINER HAVING A SEALED COMPARTMENT

This application is a U.S. National Stage Application of International Application No. PCT/EP2021/060411 filed Apr. 21, 2021, which was published in English on Oct. 28, 2021, as International Publication No. WO 2021/214149 A1. International Application No. PCT/EP2021/060411 claims priority to European Application No. 20170731.2 filed Apr. 21, 2020.

The present disclosure relates to a container for consumer goods, the container comprising a sealed compartment and an access region comprising an unsealed area. The present disclosure also relates to a method of manufacturing a packaged aerosol-generating article.

It is known to package consumer goods in containers comprising two layers of material overlying each other to form a compartment in which the consumer goods are positioned. In some examples, the two layers of material may be sealed to each other to form a sealed compartment in which the consumer goods are positioned. To open the sealed container, it may be necessary to peel one of the layers of material away from the other layer of material. It is desirable to make a container that is easy to open for a consumer. However, it is also desirable to make a container that reduces the risk of the container being opened accidentally. Typically, providing a container that is difficult to open accidentally but easy to open when desired is challenging.

According to a first aspect of the present disclosure there is provided a container for consumer goods, the container comprising a first substrate layer and a second substrate layer overlying the first substrate layer. A first portion of the first substrate layer and a first portion of the second substrate layer form a compartment region, wherein a perimeter of the compartment region is completely sealed to form a sealed compartment for containing one or more consumer goods. A second portion of the first substrate layer and a second portion of the second substrate layer form an access region directly adjacent to the compartment region. The access region comprises an unsealed area, wherein a perimeter of the access region extends around the unsealed area. The first substrate layer is attached to the second substrate layer at the perimeter of the access region. The unsealed area is separated from the sealed compartment by the completely sealed perimeter of the compartment region. The container further comprises a line of weakness extending at least partially within the unsealed area of the access region.

As used herein, the term "sealed" refers to a portion of the container at which the first substrate layer is secured to the second substrate layer. When referring to a perimeter of a region of the container, the term "completely sealed" refers to a perimeter that is sealed along 100 percent of the length of the perimeter.

As used herein, the term "directly adjacent" is used to refer to a first portion of the container being adjacent to a second portion of the container without any intervening portions of the container being positioned between the first portion and the second portion. The access region is directly adjacent to the compartment region.

For ease of reference, the perimeter of the access region may be herein referred to as the "access region perimeter". The perimeter of the compartment region may be herein referred to as the "compartment region perimeter".

Advantageously, the unsealed area of the access region facilitates opening of the container by a user. For example, after breaking the line of weakness in the unsealed area, a user may grasp the first substrate layer at the unsealed area with one hand and grasp the second substrate layer at the unsealed area with the other hand, then peel the first substrate layer away from the second substrate layer along at least part of the completely sealed compartment region perimeter.

Advantageously, the attachment of the first substrate layer to the second substrate layer at the perimeter of the access region may reduce the risk of accidental opening of the container, or prevent accidental opening of the container. For example, the attachment of the first substrate layer to the second substrate layer at the access region perimeter may prevent a user from separately grasping the first substrate layer and the second substrate layer at the unsealed area.

Advantageously, providing a line of weakness extending at least partially within the unsealed area may facilitate a user opening the container when desired. For example, by breaking at least one of the first substrate layer and the second substrate layer along the line of weakness in the unsealed area may allow a user to separately grasp the first substrate layer and the second substrate layer at the unsealed area.

The unsealed area may be separated from the sealed compartment by the completely sealed perimeter of the compartment region and the perimeter of the access region.

The line of weakness may be in only one of the first substrate layer and the second substrate layer. Advantageously, providing the line of weakness in only one of the first substrate layer and the second substrate layer may facilitate the container remaining as a single piece when the first substrate layer or the second substrate layer is broken along the line of weakness. Advantageously, this may reduce or prevent littering by minimising the number of pieces of the container to be discarded by a user when the container has been opened and is no longer required. For example, in embodiments in which the line of weakness is in the first substrate layer only, even if the first substrate layer is broken into two pieces when the container is broken along the line of weakness, the two pieces of the first substrate layer may remain attached to the single second substrate layer by the completely sealed compartment region perimeter and the access region perimeter.

The line of weakness may be in both the first substrate layer and the second substrate layer. Advantageously, providing the line of weakness in both the first substrate layer and the second substrate layer may facilitate breaking of both the first substrate layer and the second substrate layer in the unsealed area. Advantageously, breaking both the first substrate layer and the second substrate layer may facilitate a user separately grasping the first substrate layer and the second substrate layer at the unsealed area.

The line of weakness may extend between a first edge of the container and a second edge of the container.

Advantageously, the line of weakness extending between the first edge of the container and the second edge of the container may facilitate a user breaking at least one of the first substrate layer and the second substrate layer along the line of weakness. For example, starting from the first edge of the first substrate layer or the second edge of the first substrate layer, a user may tear or otherwise break at least one of the first substrate layer and the second substrate layer along the line of weakness.

Advantageously, the line of weakness extending between the first edge of the container and the second edge of the container may facilitate detachment of a part of the container comprising a part of the unsealed area of the access region when the container is broken along the line of weakness. Advantageously, detaching a part of the container comprising a part of the unsealed area may facilitate a user separately grasping the first substrate layer and the second substrate layer at the remaining part of the unsealed area of the access region.

The perimeter of the access region may comprise at least one unsealed portion, wherein the line of weakness extends across the at least one unsealed portion. Advantageously, the at least one unsealed portion may facilitate a user separately grasping the first substrate layer and the second substrate layer at the perimeter of the access region once the container has been broken along the line of weakness. Advantageously, the at least one unsealed portion may be positioned at an edge of the container. Advantageously, positioning the at least one unsealed portion at an edge of the container may facilitate a user separately grasping the first substrate layer and the second substrate layer at an edge of the container once the container has been broken along the line of weakness. Advantageously, separately grasping the first substrate layer and the second substrate layer at an edge of the container may reduce a force required to separate the first substrate layer from the second substrate layer along the sealed compartment region perimeter when opening the container.

The at least one unsealed portion may comprise a first unsealed portion and a second unsealed portion, wherein a first end of the line of weakness extends across the first unsealed portion and wherein a second end of the line of weakness extends across the second unsealed portion. Advantageously, this configuration may further facilitate a user separately grasping the first substrate layer and the second substrate layer at the access region once the container has been broken along the line of weakness. The first unsealed portion, the second unsealed portion and the unsealed area of the access region may extend continuously between a first edge of the container and a second edge of the container.

The line of weakness may extend across a part of the sealed perimeter of the compartment region. Advantageously, the line of weakness extending across part of the sealed perimeter of the compartment region may facilitate opening of the compartment region when a user breaks the container along the line of weakness. In other words, the line of weakness extending across part of the sealed compartment region perimeter may facilitate a user separating the first substrate layer from the second substrate layer across at least part of the sealed compartment region perimeter when opening the container.

The line of weakness may comprise a first end extending across a first part of the sealed perimeter of the compartment region and a second end extending across a second part of the sealed perimeter of the compartment region. Advantageously, first and second ends of the line of weakness extending across first and second parts of the sealed compartment region perimeter may further facilitate opening of the compartment region when a user breaks the container along the line of weakness.

Preferably, a central portion of the line of weakness extends across part of the unsealed area of the access region. Advantageously, when opening the container, a user may first break the container at the central portion of the line of weakness. Advantageously, breaking the container at the central portion of the line of weakness in the unsealed area may allow a user to separately grasp the first substrate layer and the second substrate layer. Advantageously, pulling the first substrate layer away from the second substrate layer at the central portion of the line of weakness may propagate further breaking of the line of weakness simultaneously from the central portion to the first end of the line of weakness and the second end of the line of weakness.

The line of weakness may be linear. In other words, the line of weakness may extend along a substantially straight line. Advantageously, a linear line of weakness may facilitate simple manufacture of the container. Advantageously, a linear line of weakness may facilitate a user tearing or otherwise breaking the container along the line of weakness. A linear line of weakness may be particularly advantageous in embodiments in which the line of weakness extends between a first edge of the container and a second edge of the container.

At least a portion of the line of weakness may be curved. Advantageously, a curved line of weakness may facilitate providing part of at least one of the first substrate layer and the second substrate layer with a desired shape when the container is broken along the line of weakness.

The perimeter of the access region may be completely sealed. Advantageously, a completely sealed access region perimeter may further reduce the risk of accidental opening of the container.

The line of weakness may be a first line of weakness in the first substrate layer only, the container further comprising a second line of weakness in the second substrate layer only.

Preferably, the second line of weakness extends at least partially within the unsealed area of the access region. Advantageously, the second line of weakness extending at least partially within the unsealed area of the access region may further facilitate a user separately grasping the first substrate layer and the second substrate layer at the unsealed area when the container is broken along the first line of weakness and the second line of weakness.

The second line of weakness may at least partially overlie the first line of weakness. Advantageously, the second line of weakness at least partially overlying the first line of weakness may facilitate a user breaking the container along both the first line of weakness and the second line of weakness at the same time.

The second line of weakness may have a different shape to the first line of weakness. Advantageously, the second line of weakness having a different shape to the first line of weakness may result in a part of the first substrate layer having a different shape to a part of the second substrate layer when the container is broken along the first line of weakness and the second line of weakness. Advantageously, providing part of the first substrate layer with a different shape to part of the second substrate layer after the container has been broken along the first line of weakness and the second line of weakness may facilitate a user separately grasping the first substrate layer and the second substrate layer at the unsealed area. Advantageously, providing part of the first substrate layer with a different shape to part of the second substrate layer after the container has been broken along the first line of weakness and the second line of weakness may provide the container with one or more additional features or functions.

Preferably, the difference in shape between the first line of weakness and the second line of weakness defines a closure tab in the second substrate layer in the unsealed area of the access region. Advantageously, the closure tab may facilitate reclosing of the container after the container has been broken along the first line of weakness and the second line of weakness. For example, a part of the first substrate layer may be tucked underneath the closure tab formed by the second substrate layer to retain the first substrate layer in a closed position.

Preferably, the first portion of at least one of the first substrate layer and the second substrate layer comprises a recess, wherein the recess at least partially defines the compartment for containing one or more consumer goods. Advantageously, a recess may increase the storage capacity of the compartment. Advantageously, the recess may facilitate positioning of one or more consumer goods within the compartment during manufacture of the container. Advantageously, the recess may facilitate retention of one or more consumer goods within the compartment.

The first portion of the first substrate layer may comprise a recess and the second substrate layer may be substantially planar. The first portion of the second substrate layer may comprise a recess and the first substrate layer may be substantially planar.

The first portion of the first substrate layer may comprise a first recess and the first portion of the second substrate layer may comprise a second recess overlying the first recess, wherein the first recess and the second recess together define the compartment for receiving one or more consumer goods. Preferably, the first recess and the second recess are the same size. Preferably, the first recess and the second recess are the same shape.

The line of weakness may comprise at least one of a perforation line, a fold line, a creasing line and a scored line. Preferably, the line of weakness comprises a perforation line. Advantageously, a perforation line may be easy to form during the manufacturing process of the first substrate layer, the second substrate layer, or the container. Advantageously, it may be easy for a user to break the container along a perforation line. Advantageously, a perforation line may facilitate tearing of the container along the line of weakness.

In embodiments in which the container comprises a first line of weakness and a second line of weakness, each of the first line of weakness and the second line of weakness may comprise at least one of a perforation line, a fold line, a creasing line and a scored line. Preferably, each of the first line of weakness and the second line of weakness comprises a perforation line.

Each of the first substrate layer and the second substrate layer may comprise a laminate material. The laminate material may comprise at least one layer of paper and at least one layer of a polymeric film. Advantageously, the at least one layer of paper may be biodegradable. Advantageously, the at least one layer of a polymeric film may facilitate securing the first substrate layer to the second substrate layer at each of the first sealed region and the second sealed region.

Preferably, the at least one layer of paper forms an outer surface of each of the first substrate layer and the second substrate layer. Preferably, the at least one layer of a polymeric film forms an inner surface of each of the first substrate layer and the second substrate layer.

The laminate material may comprise a layer of paper, a first layer of a polymeric film underlying the layer of paper, a second layer of a polymeric film underlying the first layer of a polymeric film, and a third layer of a polymeric film underlying the second layer of a polymeric film. Advantageously, the second layer of a polymeric film may form an impermeable barrier layer. Advantageously, the first layer of a polymeric film may secure the layer of paper to the impermeable barrier layer. Advantageously, the third layer of a polymeric film may facilitate securing the first substrate layer to the second substrate layer at each of the completely sealed compartment region perimeter and the access region perimeter. Each of the first layer of a polymeric film and the third layer of a polymeric film may comprise polyethylene. The second layer of a polymeric film may comprise ethylene vinyl alcohol.

The first substrate layer may be secured to the second substrate layer in each of the completely sealed compartment region perimeter and the access region perimeter using at least one of an adhesive and a weld. The first substrate layer may be secured to the second substrate layer in each of the completely sealed compartment region perimeter and the access region perimeter using a thermal weld. A thermal weld may be particularly advantageous in embodiments in which each of the first substrate layer and the second substrate layer comprises a laminate material comprising at least one layer of paper and at least one layer of a polymeric film.

According to a second aspect of the present disclosure there is provided a packaged aerosol-generating article comprising a container according to the first aspect of the present invention, in accordance with any of the embodiments described herein. The packaged aerosol-generating article also comprises an aerosol-generating article sealed within the compartment.

As used herein, the term "aerosol-generating article" refers to an article comprising an aerosol-forming substrate that is capable of releasing volatile compounds that can form an aerosol. Such volatile compounds may be released by heating the aerosol-forming substrate. An aerosol-generating article may be disposable.

The aerosol-generating article may be a filter cigarette or other smoking article in which an aerosol-forming substrate comprises a tobacco material that is combusted to form smoke. The aerosol-generating article may be an article in which a tobacco material is heated to form an aerosol, rather than combusted. The aerosol-generating article may be an article in which a nicotine-containing aerosol is generated from a tobacco material, tobacco extract, or other nicotine source, without combustion, and in some cases without heating, for example through a chemical reaction.

The aerosol-generating article may be a cartridge comprising a housing and an aerosol-forming substrate positioned within the housing. The aerosol-forming substrate may be a liquid aerosol-forming substrate. The liquid aerosol-forming substrate may be a nicotine-containing liquid. The cartridge may be configured for coupling to an aerosol-generating device.

As used herein, the term "aerosol-generating device" refers to a device that interacts with an aerosol-generating article comprising an aerosol-forming substrate to generate an aerosol.

As described herein, at least one of the first substrate layer and the second substrate layer of a container according to the first aspect of the present invention may comprise a recess at least partially defining the compartment for receiving one or more consumer goods. Additionally, it is known more generally to package consumer goods in a container comprising a recess for receiving the consumer goods. When forming at least part of a container from a sheet material, it may be desirable to form the recess into the sheet material during manufacture of the container. However, in some cases it is difficult to form a recess of sufficient size to accommodate the consumer goods without tearing or damaging the sheet material.

According to a third aspect of the present disclosure there is provided a plug assist thermoforming process comprising providing a mold and a plug, wherein the plug comprises a plug body and an elastomeric cover extending over at least a portion of the plug body. The plug assist thermoforming process also comprises heating a web of substrate material to form a heated web of substrate material and positioning the heated web of substrate material between the mold and the plug. The plug assist thermoforming process also comprises engaging the elastomeric cover of the plug with the heated web of substrate material and inserting the plug into the mold to form the heated web of substrate material to the shape of the mold.

Advantageously, the plug assist thermoforming process according to the present invention may be used to form a recess in a substrate material when forming a container for consumer goods.

Advantageously, the present inventors have recognised that providing an elastomeric cover extending over at least a portion of the plug body may facilitate the formation of a deeper recess without tearing or breaking the substrate material than is possible when using a conventional plug comprising only a plug body.

The elastomeric cover may be formed from any suitable material exhibiting elastic or rubber like properties.

The plug body may be formed from at least one metal. The at least one metal may comprise a metal alloy. The plug body may be formed from a steel. The plug body may be formed from a stainless steel.

Preferably, the plug body has a shape comprising one or more rounded vertices and one or more rounded edges. Advantageously, rounded vertices and rounded edges may reduce the risk of the plug tearing or breaking the substrate material. Preferably, at least a portion of the plug body has a rounded cuboid shape.

Preferably, the step of heating a web of substrate material comprises heating the web of substrate material to a temperature of between about 65 degrees Celsius and about 95 degrees Celsius, preferably between about 65 degrees Celsius and about 75 degrees Celsius.

The web of substrate material may comprise a laminate material. The laminate material may comprise at least one layer of paper and at least one layer of a polymeric film. Advantageously, the at least one layer of paper may be biodegradable. Advantageously, the at least one layer of a polymeric film may facilitate securing the web of substrate material to one or more additional materials in a subsequent manufacturing process. For example, the at least one layer of a polymeric film may facilitate securing the web of substrate material to an additional polymeric material using a thermal weld.

Preferably, the step of engaging the elastomeric cover of the plug with the heated web of substrate material comprises engaging the elastomeric cover of the plug with the at least one layer of a polymeric film.

The laminate material may comprise a layer of paper, a first layer of a polymeric film underlying the layer of paper, a second layer of a polymeric film underlying the first layer of a polymeric film, and a third layer of a polymeric film underlying the second layer of a polymeric film. Advantageously, the second layer of a polymeric film may form an impermeable barrier layer. Advantageously, the first layer of a polymeric film may secure the layer of paper to the impermeable barrier layer. Advantageously, the third layer of a polymeric film may facilitate securing the first substrate layer to the second substrate layer at each of the first sealed region and the second sealed region. Each of the first layer of a polymeric film and the third layer of a polymeric film may comprise polyethylene. The second layer of a polymeric film may comprise ethylene vinyl alcohol.

According to a fourth aspect of the present disclosure there is provided a method of forming a packaged aerosol-generating article, the method comprising providing a first web of substrate material, and forming a first recess in the first web of substrate material using a plug assist thermoforming process according to the third aspect of the present disclosure, in accordance with any of the embodiments described herein. The method also comprises positioning an aerosol-generating article in the first recess, providing a second web of substrate material, and positioning the second web of substrate material over the aerosol-generating article and the first web of substrate material. The method also comprises securing the second web of substrate material to the first web of substrate material around the aerosol-generating article to form a compartment between the first web of substrate material and the second web of substrate material, wherein the first recess at least partially defines the compartment and wherein the aerosol-generating article is sealed within the compartment. The method also comprises cutting the first web of substrate material and the second web of substrate material to form a packaged aerosol-generating article, the packaged aerosol-generating article comprising the aerosol-generating article and a container comprising a first substrate layer, a second substrate layer, and the compartment.

The method may further comprise forming a second recess in the second web of substrate material using a plug assist thermoforming process according to the third aspect of the present disclosure, in accordance with any of the embodiments described herein. Preferably, the step of positioning the second web of substrate material over the aerosol-generating article and the first web of substrate material comprises positioning the second recess over the aerosol-generating article, wherein the first recess and the second recess together define the compartment.

The aerosol-generating article may comprise any of the optional or preferred features described herein with respect to the second aspect of the present disclosure.

According to a fifth aspect of the present disclosure there is provided a method of forming a packaged aerosol-generating article, the method comprising providing a first web of substrate material, and positioning an aerosol-generating article on the first web of substrate material. The method also comprises providing a second web of substrate material, and positioning the second web of substrate material over the aerosol-generating article and the first web of substrate material. The method also comprises securing a first portion of the first web of substrate material to a first portion of the second web of substrate material to form a compartment region, wherein a perimeter of the compartment region is completely sealed to form a sealed compartment, and wherein the aerosol-generating article is contained within the sealed compartment. The method also comprises securing a second portion of the first web of substrate material to a second portion of the second web of substrate material to form an access region directly adjacent to the compartment region, wherein the access region comprises an unsealed area, wherein a perimeter of the access region extends around the unsealed area, wherein the first substrate layer is attached to the second substrate layer at the perimeter of the access region, and wherein the unsealed area is separated from the sealed compartment by the completely sealed perimeter of the compartment region. The method also comprises forming a line of weakness in at least one of the first web of substrate material and the second web of substrate material, wherein the line of weakness extends at least partially within the unsealed area of the access region. The method also comprises cutting the first web of substrate material and the second web of substrate material to form a packaged aerosol-generating article, the packaged aerosol-generating article comprising the aerosol-generating article and a container comprising a first substrate layer, a second substrate layer, the compartment region, the access region and the line of weakness.

Advantageously, the unsealed area of the access region facilitates opening of the container by a user. For example, a user may grasp the first substrate layer at the unsealed area with one hand and grasp the second substrate layer at the unsealed area with the other hand, then peel the first substrate layer away from the second substrate layer along at least part of the completely sealed compartment region perimeter.

Advantageously, the attachment of the first substrate layer to the second substrate layer at the perimeter of the access region may reduce the risk of accidental opening of the container, or prevent accidental opening of the container. For example, the attachment of the first substrate layer to the second substrate layer at the access region perimeter may prevent a user from separately grasping the first substrate layer and the second substrate layer at the unsealed area.

Advantageously, providing a line of weakness extending at least partially within the unsealed area may facilitate a user opening the container when desired. For example, by breaking at least one of the first substrate layer and the second substrate layer along the line of weakness in the unsealed area may allow a user to separately grasp the first substrate layer and the second substrate layer at the unsealed area.

The packaged aerosol-generating article formed according to the method of the fifth aspect of the present disclosure may be a packaged aerosol-generating article according to the second aspect of the present disclosure, in accordance with any of the embodiments described herein.

The unsealed area may be separated from the sealed compartment by the completely sealed perimeter of the compartment region and the perimeter of the access region.

The step of forming the line of weakness may comprise forming the line of weakness in only one of the first web of substrate material and the second web of substrate material. Advantageously, providing the line of weakness in only one of the first substrate layer and the second substrate layer may facilitate the container remaining as a single piece when the first substrate layer or the second substrate layer is broken along the line of weakness. Advantageously, this may reduce or prevent littering by minimising the number of pieces of the container to be discarded by a user when the container has been opened and is no longer required. For example, in embodiments in which the line of weakness is in the first substrate layer only, even if the first substrate layer is broken into two pieces when the container is broken along the line of weakness, the two pieces of the first substrate layer may remain attached to the single second substrate layer by the completely sealed compartment region perimeter and the access region perimeter.

The step of forming the line of weakness may comprise forming the line of weakness in both the first web of substrate material and the second web of substrate material. Advantageously, providing the line of weakness in both the first substrate layer and the second substrate layer may facilitate breaking of both the first substrate layer and the second substrate layer in the unsealed area. Advantageously, breaking both the first substrate layer and the second substrate layer may facilitate a user separately grasping the first substrate layer and the second substrate layer at the unsealed area.

The line of weakness may extend between a first edge of the container and a second edge of the container.

Advantageously, the line of weakness extending between the first edge of the container and the second edge of the container may facilitate a user breaking at least one of the first substrate layer and the second substrate layer along the line of weakness. For example, starting from the first edge of the first substrate layer or the second edge of the first substrate layer, a user may tear or otherwise break at least one of the first substrate layer and the second substrate layer along the line of weakness.

Advantageously, the line of weakness extending between the first edge of the container and the second edge of the container may facilitate detachment of a part of the container comprising a part of the unsealed area when the container is broken along the line of weakness. Advantageously, detaching a part of the container comprising part of the unsealed area may facilitate a user separately grasping the first substrate layer and the second substrate layer at the remaining part of the unsealed area.

The perimeter of the access region may comprise at least one unsealed portion, wherein the line of weakness extends across the at least one unsealed portion. Advantageously, the at least one unsealed portion may facilitate a user separately grasping the first substrate layer and the second substrate layer at the perimeter of the access region once the container has been broken along the line of weakness. Advantageously, the at least one unsealed portion may be positioned at an edge of the container. Advantageously, positioning the at least one unsealed portion at an edge of the container may facilitate a user separately grasping the first substrate layer and the second substrate layer at an edge of the container once the container has been broken along the line of weakness. Advantageously, separately grasping the first substrate layer and the second substrate layer at an edge of the container may reduce a force required to separate the first substrate layer from the second substrate layer along the sealed compartment region perimeter when opening the container.

The at least one unsealed portion may comprise a first unsealed portion and a second unsealed portion, wherein a first end of the line of weakness extends across the first unsealed portion and wherein a second end of the line of weakness extends across the second unsealed portion. Advantageously, this configuration may further facilitate a user separately grasping the first substrate layer and the second substrate layer at the access region once the container has been broken along the line of weakness. The first unsealed portion, the second unsealed portion and the unsealed area of the access region may extend continuously between a first edge of the container and a second edge of the container.

The line of weakness may extend across a part of the sealed perimeter of the compartment region. Advantageously, the line of weakness extending across part of the sealed perimeter of the compartment region may facilitate opening of the compartment region when a user breaks the container along the line of weakness. In other words, the line of weakness extending across part of the sealed compartment region perimeter may facilitate a user separating the first substrate layer from the second substrate layer across at least part of the sealed compartment region perimeter when opening the container.

The line of weakness may comprise a first end extending across a first part of the sealed perimeter of the compartment region and a second end extending across a second part of the sealed perimeter of the compartment region. Advantageously, first and second ends of the line of weakness extending across first and second parts of the sealed compartment region perimeter may further facilitate opening of the compartment region when a user breaks the container along the line of weakness.

Preferably, a central portion of the line of weakness extends across part of the unsealed area of the access region. Advantageously, when opening the container, a user may first break the container at the central portion of the line of weakness. Advantageously, breaking the container at the central portion of the line of weakness in the unsealed area may allow a user to separately grasp the first substrate layer and the second substrate layer. Advantageously, pulling the first substrate layer away from the second substrate layer at the central portion of the line of weakness may propagate further breaking of the line of weakness simultaneously from the central portion to the first end of the line of weakness and the second end of the line of weakness.

The line of weakness may be linear. In other words, the line of weakness may extend along a substantially straight line. Advantageously, a linear line of weakness may facilitate simple manufacture of the container. Advantageously, a linear line of weakness may facilitate a user tearing or otherwise breaking the container along the line of weakness. A linear line of weakness may be particularly advantageous in embodiments in which the line of weakness extends between a first edge of the container and a second edge of the container.

At least a portion of the line of weakness may be curved. Advantageously, a curved line of weakness may facilitate providing part of at least one of the first substrate layer and the second substrate layer with a desired shape when the container is broken along the line of weakness.

The perimeter of the access region may be completely sealed. Advantageously, a completely sealed access region perimeter may further reduce the risk of accidental opening of the container.

The line of weakness may be a first line of weakness in the first web of substrate material only, the method further comprising a step of forming a second line of weakness in the second web of substrate material only.

Preferably, the second line of weakness extends at least partially within the unsealed area of the access region. Advantageously, the second line of weakness extending at least partially within the unsealed area of the access region may further facilitate a user separately grasping the first substrate layer and the second substrate layer at the unsealed area when the container is broken along the first line of weakness and the second line of weakness.

The second line of weakness may at least partially overlie the first line of weakness. Advantageously, the second line of weakness at least partially overlying the first line of weakness may facilitate a user breaking the container along both the first line of weakness and the second line of weakness at the same time.

The second line of weakness may have a different shape to the first line of weakness. Advantageously, the second line of weakness having a different shape to the first line of weakness may result in a part of the first substrate layer having a different shape to a part of the second substrate layer when the container is broken along the first line of weakness and the second line of weakness. Advantageously, providing part of the first substrate layer with a different shape to part of the second substrate layer after the container has been broken along the first line of weakness and the second line of weakness may facilitate a user separately grasping the first substrate layer and the second substrate layer at the unsealed area. Advantageously, providing part of the first substrate layer with a different shape to part of the second substrate layer after the container has been broken along the first line of weakness and the second line of weakness may provide the container with one or more additional features or functions.

Preferably, the difference in shape between the first line of weakness and the second line of weakness defines a closure tab in the second substrate layer in the unsealed area of the access region. Advantageously, the closure tab may facilitate reclosing of the container after the container has been broken along the first line of weakness and the second line of weakness. For example, a part of the first substrate layer may be tucked underneath the closure tab formed by the second substrate layer to retain the first substrate layer in a closed position.

The method may comprise a step of forming a recess in at least one of the first portion of the first web of substrate material and the first portion of the second web of substrate material, wherein the recess at least partially defines the compartment for containing one or more consumer goods. Advantageously, a recess may increase the storage capacity of the compartment. Advantageously, the recess may facilitate positioning of one or more consumer goods within the compartment during manufacture of the container. Advantageously, the recess may facilitate retention of one or more consumer goods within the compartment.

The first portion of the first web of substrate material may comprise a recess and the second web of substrate material may be substantially planar. The first portion of the second web of substrate material may comprise a recess and the first web of substrate material may be substantially planar.

The step of forming a recess comprises forming a first recess in the first portion of the first web of substrate material and forming a second recess in the first portion of the second web of substrate material, wherein the step of positioning the second web of substrate material over the aerosol-generating article and the first web of substrate material comprises positioning the second recess over the aerosol-generating article, and wherein the first recess and the second recess together define the compartment.

The step of forming a recess may comprise forming the recess using a plug assist thermoforming process. In embodiments in which the step of forming a recess comprises forming a first recess and forming a second recess, each of the first recess and the second recess may be formed using a plug assist thermoforming process.

The plug assist thermoforming process may be a plug assist thermoforming process according to the third aspect of the present disclosure, in accordance with any of the embodiments described herein.

The plug assist thermoforming process may comprise a step of forming the recess with a mold and a plug, wherein the plug comprises a plug body and an elastomeric cover extending over at least a portion of the plug body.

The elastomeric cover may be formed from any suitable material exhibiting elastic or rubber like properties.

The plug body may be formed from at least one metal. The at least one metal may comprise a metal alloy. The plug body may be formed from a steel. The plug body may be formed from a stainless steel.

Preferably, the plug body has a shape comprising one or more rounded vertices and one or more rounded edges. Advantageously, rounded vertices and rounded edges may reduce the risk of the plug tearing or breaking the substrate material. Preferably, at least a portion of the plug body has a rounded cuboid shape.

Preferably, the plug assist thermoforming process comprises a step of heating at least one of the first web of substrate material and the second web of substrate material to a temperature of between about 65 degrees Celsius and about 95 degrees Celsius, preferably between about 65 degrees Celsius and about 75 degrees Celsius.

The step of forming the line of weakness may comprise forming at least one of a perforation line, a fold line, a creasing line and a scored line. Preferably, the step of forming the line of weakness comprises forming a perforation line. Advantageously, a perforation line may be easy to form during the manufacturing process. Advantageously, it may be easy for a user to break the container along a perforation line. Advantageously, a perforation line may facilitate tearing of the container along the line of weakness.

In embodiments in which the container comprises a first line of weakness and a second line of weakness, each of the first line of weakness and the second line of weakness may comprise at least one of a perforation line, a fold line, a creasing line and a scored line. Preferably, each of the first line of weakness and the second line of weakness comprises a perforation line.

Each of the first web of substrate material and the second web of substrate material may comprise a laminate material. In embodiments in which each of the first web of substrate material and the second web of substrate material comprises a laminate material, each of the first substrate layer and the second substrate layer comprises the laminate material.

The laminate material may comprise at least one layer of paper and at least one layer of a polymeric film. Advantageously, the at least one layer of paper may be biodegradable. Advantageously, the at least one layer of a polymeric film may facilitate securing the first web of substrate material to the second web of substrate material at each of the completely sealed compartment region perimeter and the access region perimeter.

Preferably, the at least one layer of paper forms an outer surface of each of the first substrate layer and the second substrate layer. Preferably, the at least one layer of a polymeric film forms an inner surface of each of the first substrate layer and the second substrate layer.

The laminate material may comprise a layer of paper, a first layer of a polymeric film underlying the layer of paper, a second layer of a polymeric film underlying the first layer of a polymeric film, and a third layer of a polymeric film underlying the second layer of a polymeric film. Advantageously, the second layer of a polymeric film may form an impermeable barrier layer. Advantageously, the first layer of a polymeric film may secure the layer of paper to the impermeable barrier layer. Advantageously, the third layer of a polymeric film may facilitate securing the first web of substrate material to the second web of substrate material at each of the completely sealed compartment region perimeter and the access region perimeter. Each of the first layer of a polymeric film and the third layer of a polymeric film may comprise polyethylene. The second layer of a polymeric film may comprise ethylene vinyl alcohol.

The steps of securing the first web of substrate material to the second web of substrate material at each of the completely sealed compartment region perimeter and the access region perimeter may comprise securing the second web of substrate material to the first web of substrate material using at least one of an adhesive and a weld. The first web of substrate material may be secured to the second web of substrate material in each of the completely sealed compartment region perimeter and the access region perimeter using a thermal weld. A thermal weld may be particularly advantageous in embodiments in which each of the first web of substrate material and the second web of substrate material comprises a laminate material comprising at least one layer of paper and at least one layer of a polymeric film.

The aerosol-generating article may be a filter cigarette or other smoking article in which an aerosol-forming substrate comprises a tobacco material that is combusted to form smoke. The aerosol-generating article may be an article in which a tobacco material is heated to form an aerosol, rather than combusted. The aerosol-generating article may be an article in which a nicotine-containing aerosol is generated from a tobacco material, tobacco extract, or other nicotine source, without combustion, and in some cases without heating, for example through a chemical reaction.

The aerosol-generating article may be a cartridge comprising a housing and an aerosol-forming substrate positioned within the housing. The aerosol-forming substrate may be a liquid aerosol-forming substrate. The liquid aerosol-forming substrate may be a nicotine-containing liquid. The cartridge may be configured for coupling to an aerosol-generating device. The cartridge may comprise a heater arranged to heat the aerosol-forming substrate. The heater may be an electric heater. The electric heater may be arranged to receive a supply of electrical power from an aerosol-generating device when the cartridge is coupled to an aerosol-generating device.

The invention is defined in the claims. However, below there is provided a non-exhaustive list of non-limiting examples. Any one or more of the features of these examples may be combined with any one or more features of another example, embodiment, or aspect described herein.

Example Ex1: A container for consumer goods, the container comprising:

a first substrate layer;

a second substrate layer overlying the first substrate layer;

wherein a first portion of the first substrate layer and a first portion of the second substrate layer form a compartment region, wherein a perimeter of the compartment region is completely sealed to form a sealed compartment for containing one or more consumer goods;

wherein a second portion of the first substrate layer and a second portion of the second substrate layer form an access region directly adjacent to the compartment region, wherein the access region comprises an unsealed area, wherein a perimeter of the access region extends around the unsealed area, wherein the first substrate layer is attached to the second substrate layer at the perimeter of the access region, wherein the unsealed area is separated from the sealed compartment by the completely sealed perimeter of the compartment region; and wherein the container further comprises a line of weakness extending at least partially within the unsealed area of the access region.

Example Ex2: A container according to Example Ex1, wherein the unsealed area is separated from the sealed compartment by the completely sealed perimeter of the compartment region and the perimeter of the access region.

Example Ex3: A container according to Example Ex1 or Ex2, wherein the line of weakness is in only one of the first substrate layer and the second substrate layer.

Example Ex4: A container according to Example Ex1 or Ex2, wherein the line of weakness is in both the first substrate layer and the second substrate layer.

Example Ex5: A container according to any preceding Example, wherein the line of weakness extends between a first edge of the container and a second edge of the container.

Example Ex6: A container according to any preceding Example, wherein the perimeter of the access region comprises at least one unsealed portion, and wherein the line of weakness extends across the at least one unsealed portion.

Example Ex7: A container according to Example Ex6, wherein the at least one unsealed portion comprises a first unsealed portion and a second unsealed portion, wherein a first end of the line of weakness extends across the first unsealed portion and wherein a second end of the line of weakness extends across the second unsealed portion.

Example Ex8: A container according to any preceding Example, wherein the line of weakness extends across a part of the sealed perimeter of the compartment region.

Example Ex9: A container according to Example Ex8, wherein the line of weakness comprises a first end extending across a first part of the sealed perimeter of the compartment region and a second end extending across a second part of the sealed perimeter of the compartment region.

Example Ex10: A container according to any preceding Example, wherein the line of weakness is linear.

Example Ex11: A container according to any of Examples Ex1 to Ex9, wherein at least a portion of the line of weakness is curved.

Example Ex12: A container according to any preceding Example, wherein the perimeter of the access region is completely sealed.

Example Ex13: A container according to any preceding Example, wherein the line of weakness is a first line of weakness in the first substrate layer only, the container further comprising a second line of weakness in the second substrate layer only.

Example Ex14: A container according to Example Ex13 wherein the second line of weakness extends at least partially within the unsealed area of the access region.

Example Ex15: A container according to Example Ex13 or Ex14, wherein the second line of weakness at least partially overlies the first line of weakness.

Example Ex16: A container according to Example Ex13, Ex14 or Ex15, wherein the second line of weakness has a different shape to the first line of weakness.

Example Ex17: A container according to Example Ex16, wherein the difference in shape between the first line of weakness and the second line of weakness defines a closure tab in the second substrate layer in the unsealed area of the access region.

Example Ex18: A container according to any preceding Example, wherein the first portion of at least one of the first substrate layer and the second substrate layer comprises a recess, and wherein the recess at least partially defines the compartment for containing one or more consumer goods.

Example Ex19: A container according to Example Ex18, wherein the first portion of the first substrate layer comprises a first recess, wherein the first portion of the second substrate layer comprises a second recess overlying the first recess, and wherein the first recess and the second recess together define the compartment for containing one or more consumer goods.

Example Ex20: A container according to any preceding Example, wherein each of the first substrate layer and the second substrate layer comprises a laminate material, and wherein the laminate material comprises at least one layer of paper and at least one layer of a polymeric film.

Example Ex21: A packaged aerosol-generating article comprising:

a container according to any preceding Example; and an aerosol-generating article sealed within the compartment.

Example Ex22: A plug assist thermoforming process comprising:

providing a mold and a plug, wherein the plug comprises a plug body and an elastomeric cover extending over at least a portion of the plug body;

heating a web of substrate material to form a heated web of substrate material;

positioning the heated web of substrate material between the mold and the plug;

engaging the elastomeric cover of the plug with the heated web of substrate material;

inserting the plug into the mold to form the heated web of substrate material to the shape of the mold.

Example Ex23: A plug assist thermoforming process according to Example Ex22, wherein the elastomeric cover is formed from a material exhibiting elastic or rubber like properties.

Example Ex24: A plug assist thermoforming process according to Example Ex22 or Ex23, wherein the plug body is formed from at least one metal.

Example Ex25: A plug assist thermoforming process according to Example Ex22, Ex23 or Ex24, wherein the step of heating a web of substrate material comprises heating the web of substrate material to a temperature of between 65 degrees Celsius and 95 degrees Celsius.

Example Ex26: A plug assist thermoforming process according to any of Examples Ex22 to Ex25, wherein the web of substrate material comprises a laminate material comprising at least one layer of paper and at least one layer of a polymeric film.

Example Ex27: A method of forming a packaged aerosol-generating article, the method comprising:

providing a first web of substrate material;

forming a first recess in the first web of substrate material using a plug assist thermoforming process according to any of Examples Ex22 to Ex26;

positioning an aerosol-generating article in the first recess;

providing a second web of substrate material;

positioning the second web of substrate material over the aerosol-generating article and the first web of substrate material;

securing the second web of substrate material to the first web of substrate material around the aerosol-generating article to form a compartment between the first web of substrate material and the second web of substrate material, wherein the first recess at least partially defines the compartment and wherein the aerosol-generating article is sealed within the compartment; and cutting the first web of substrate material and the second web of substrate material to form a packaged aerosol-generating article, the packaged aerosol-generating article comprising the aerosol-generating article and a container comprising a first substrate layer, a second substrate layer, and the compartment.

Example Ex28: A method according to Example Ex27, further comprising forming a second recess in the second web of substrate material using a plug assist thermoforming process according to any of Examples Ex22 to Ex26, wherein the step of positioning the second web of substrate material over the aerosol-generating article and the first web of substrate material comprises positioning the second recess over the aerosol-generating article, and wherein the first recess and the second recess together define the compartment.

Example Ex29: A method of forming a packaged aerosol-generating article, the method comprising:

providing a first web of substrate material;

positioning an aerosol-generating article on the first web of substrate material;

providing a second web of substrate material;

positioning the second web of substrate material over the aerosol-generating article and the first web of substrate material;

securing a first portion of the first web of substrate material to a first portion of the second web of substrate material to form a compartment region, wherein a perimeter of the compartment region is completely sealed to form a sealed compartment, and wherein the aerosol-generating article is contained within the sealed compartment;

securing a second portion of the first web of substrate material to a second portion of the second web of substrate material to form an access region directly adjacent to the compartment region, wherein the access region comprises an unsealed area, wherein a perimeter of the access region extends around the unsealed area, wherein the first substrate layer is attached to the second substrate layer at the perimeter of the access region, and wherein the unsealed area is separated from the sealed compartment by the completely sealed perimeter of the compartment region;

forming a line of weakness in at least one of the first web of substrate material and the second web of substrate material, wherein the line of weakness extends at least partially within the unsealed area of the access region; and cutting the first web of substrate material and the second web of substrate material to form a packaged aerosol-generating article, the packaged aerosol-generating article comprising the aerosol-generating article and a container comprising a first substrate layer, a second substrate layer, the compartment region, the access region and the line of weakness.

Example Ex30: A method according to Example Ex29, wherein the unsealed area is separated from the sealed compartment by the completely sealed perimeter of the compartment region and the perimeter of the access region.

Example Ex31: A method according to Example Ex29, wherein the step of forming the line of weakness comprises forming the line of weakness in only one of the first web of substrate material and the second web of substrate material.

Example Ex32: A method according to Example Ex29 or Ex30, wherein the step of forming the line of weakness comprises forming the line of weakness in both the first web of substrate material and the second web of substrate material.

Example Ex33: A method according to any of Examples Ex29 to Ex32, wherein the line of weakness extends between a first edge of the container and a second edge of the container.

Example Ex34: A method according to any of Examples Ex29 to Ex33, wherein the perimeter of the access region comprises at least one unsealed portion, and wherein the line of weakness extends across the at least one unsealed portion.

Example Ex35: A method according to Example Ex34, wherein the at least one unsealed portion comprises a first unsealed portion and a second unsealed portion, wherein a first end of the line of weakness extends across the first unsealed portion and wherein a second end of the line of weakness extends across the second unsealed portion.

Example Ex36: A method according to any of Examples Ex29 to Ex35, wherein the line of weakness extends across a part of the sealed perimeter of the compartment region.

Example Ex37: A method according to Example Ex36, wherein the line of weakness comprises a first end extending across a first part of the sealed perimeter of the compartment region and a second end extending across a second part of the sealed perimeter of the compartment region.

Example Ex38: A method according to any of Examples Ex29 to Ex37, wherein the line of weakness is linear.

Example Ex39: A method according to any of Examples Ex29 to Ex37, wherein at least a portion of the line of weakness is curved.

Example Ex40: A method according to any of Examples Ex29 to Ex39, wherein the perimeter of the access region is completely sealed.

Example Ex41: A method according to any of Examples Ex28 to Ex38, wherein the line of weakness is a first line of weakness in the first web of substrate material only, the method further comprising a step of forming a second line of weakness in the second web of substrate material only.

Example Ex42: A method according to Example Ex41 wherein the second line of weakness extends at least partially within the unsealed area of the access region.

Example Ex43: A method according to Example Ex41 or Ex42, wherein the second line of weakness at least partially overlies the first line of weakness.

Example Ex44: A method according to Example Ex41, Ex42 or Ex43, wherein the second line of weakness has a different shape to the first line of weakness.

Example Ex45: A method according to Example Ex44, wherein the difference in shape between the first line of weakness and the second line of weakness defines a closure tab in the second substrate layer in the unsealed area of the access region.

Example Ex46: A method according to any of Examples Ex29 to Ex45, further comprising a step of forming a recess in at least one of the first portion of the first web of substrate material and the first portion of the second web of substrate material, wherein the recess at least partially defines the compartment for containing one or more consumer goods.

Example Ex47: A method according to Example Ex46, wherein the step of forming a recess comprises forming a first recess in the first portion of the first web of substrate material and forming a second recess in the first portion of the second web of substrate material, wherein the step of positioning the second web of substrate material over the aerosol-generating article and the first web of substrate material comprises positioning the second recess over the aerosol-generating article, and wherein the first recess and the second recess together define the compartment.

Example Ex48: A method according to Example Ex46 or Ex47, wherein the step of forming a recess comprises forming the recess using a plug assist thermoforming process.

Example Ex49: A method according to Example Ex48, wherein the plug assist thermoforming process is a plug assist thermoforming process according to any of Examples Ex22 to 25.

Example Ex50: A method according to any of Examples Ex29 to Ex49, wherein each of the first web of substrate material and the second web of substrate material comprises a laminate material, and wherein the laminate material comprises at least one layer of paper and at least one layer of a polymeric film.

Examples will now be further described with reference to the figures in which.

Figure 1:
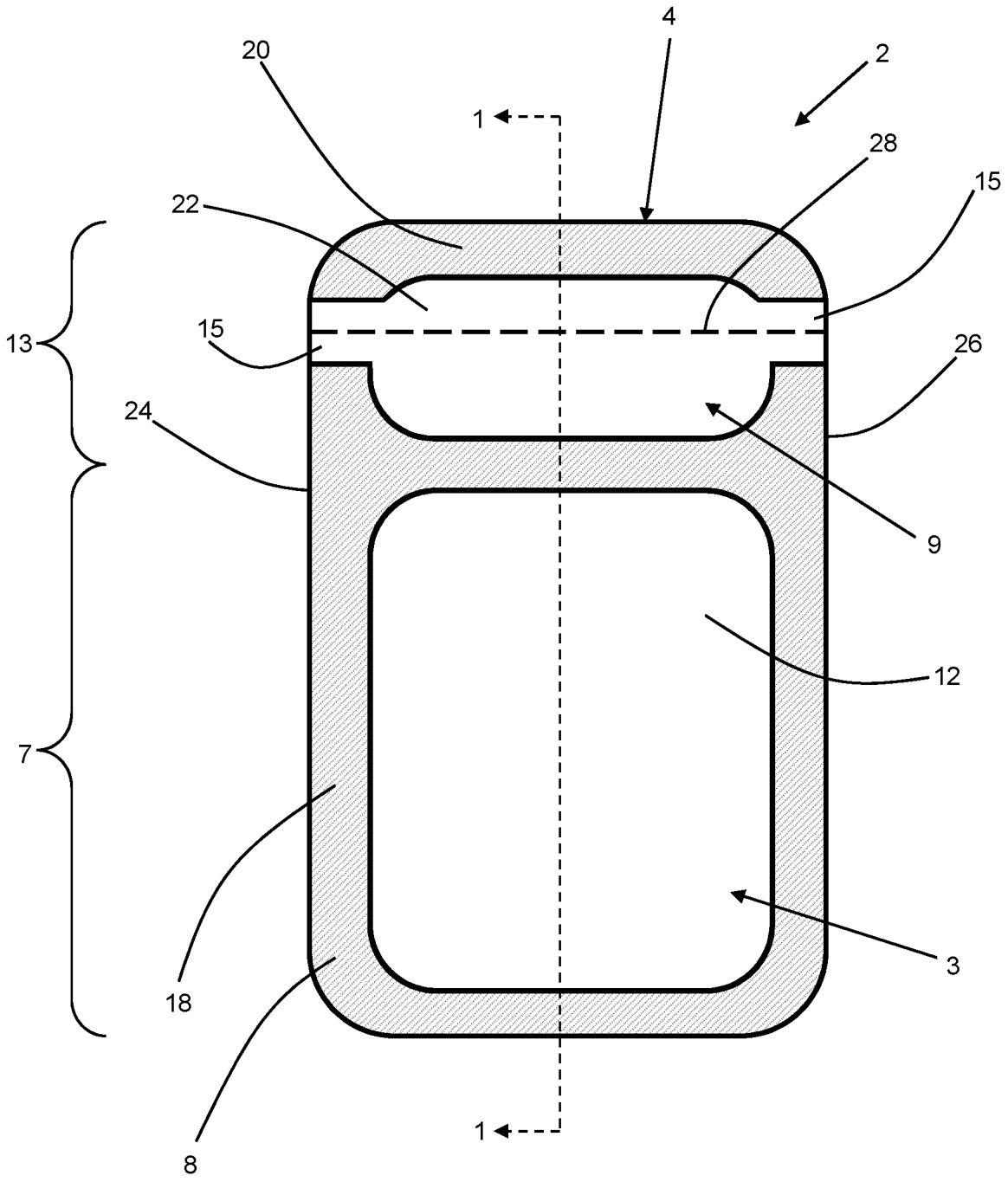
FIG. 1 shows a top view of a packaged aerosol-generating article according to a first embodiment of the present disclosure.
Figure 2:
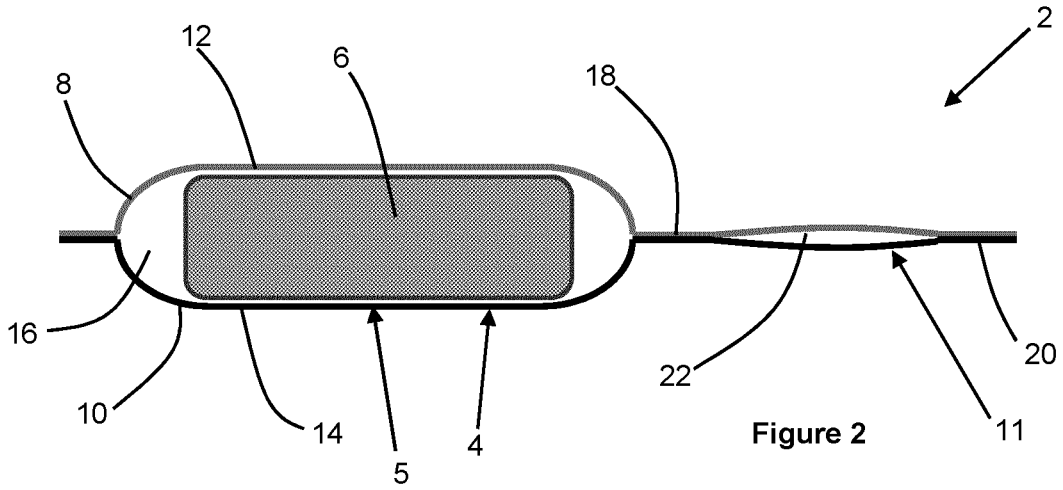
FIGS. 2 to 4 show a cross-sectional view of the packaged aerosol-generating article of FIG. 1 taken along line 1-1.

FIGS. 1 to 4 show a packaged aerosol-generating article 2 according to a first embodiment of the present disclosure. The packaged aerosol-generating article 2 comprises a container 4 and an aerosol-generating article 6 received within the container 4. The container 4 comprises a first substrate layer 8 and a second substrate layer 10 overlying the first substrate layer 8. Each of the first substrate layer 8 and the second substrate layer 10 is formed from a laminate material comprising a layer of paper forming an outer surface of the substrate layer and a layer of a polymeric film forming an inner surface of the substrate layer.

A first portion 3 of the first substrate layer 8 and a first portion 5 of the second substrate layer 10 form a compartment region 7, wherein a perimeter 18 of the compartment region 7 is completely sealed by a continuous thermal weld to form a sealed compartment 16 in which the aerosol-generating article 6 is positioned. The first portion 3 of the first substrate layer 8 comprises a first recess 12 and the first portion 5 of the second substrate layer 10 comprises a second recess 14, wherein the first recess 12 and the second recess 14 together define the compartment 16.

A second portion 9 of the first substrate layer 8 and a second portion 11 of the second substrate layer 10 form an access region 13 directly adjacent to the compartment region 7, wherein the access region 13 comprises an unsealed area 22 and wherein a perimeter 20 of the access region 13 extends around the unsealed area 22. The first substrate layer 8 is attached to the second substrate layer 10 along part of the access region perimeter 20 The access region perimeter 20 comprises two unsealed portions 15 on opposite sides of the unsealed area 22 at which the first substrate layer 8 is not attached to the second substrate layer 10. The unsealed area 22 is separated from the sealed compartment 16 by the completely sealed perimeter 18 of the compartment region 7.

A line of weakness 28 comprising a perforation line is provided in the first substrate layer 8 and the second substrate layer 10, the line of weakness 28 extending between a first edge 24 of the container 4 and a second edge 26 of the container 4.

Although the first substrate layer 8 is not secured to the second substrate layer 10 at the unsealed area 22, the attachment of the first substrate layer 8 to the second substrate layer 10 along part of the length of the access region perimeter 20 makes it difficult to separate the first substrate layer 8 from the second substrate layer 10. Therefore, the attachment of the first substrate layer 8 to the second substrate layer 10 along part of the length of the access region perimeter 20 reduces the risk of the container 4 being opened accidentally.

Opening of the container 4 to remove the aerosol-generating article 6 from the container 4 is a two-step process.

Figure 3:
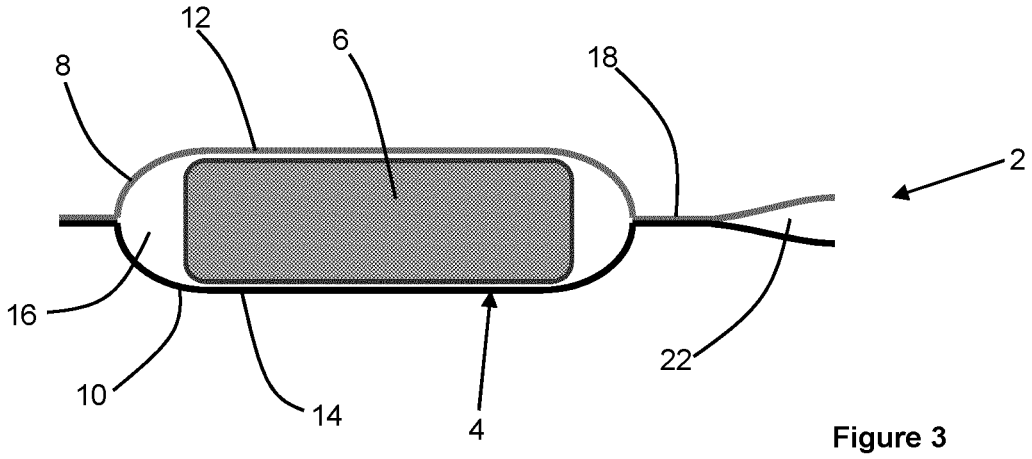

Firstly, a user tears, snaps or breaks the container 4 along the entire length of the line of weakness 28 to detach a portion of the container 4 comprising part of the access region perimeter 20. The outcome of this step is shown in FIG. 3.

Figure 4:
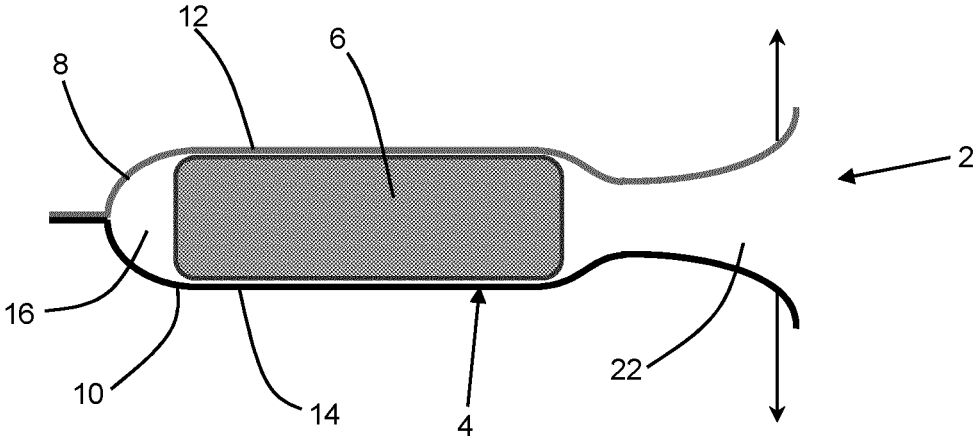
Figure 5:
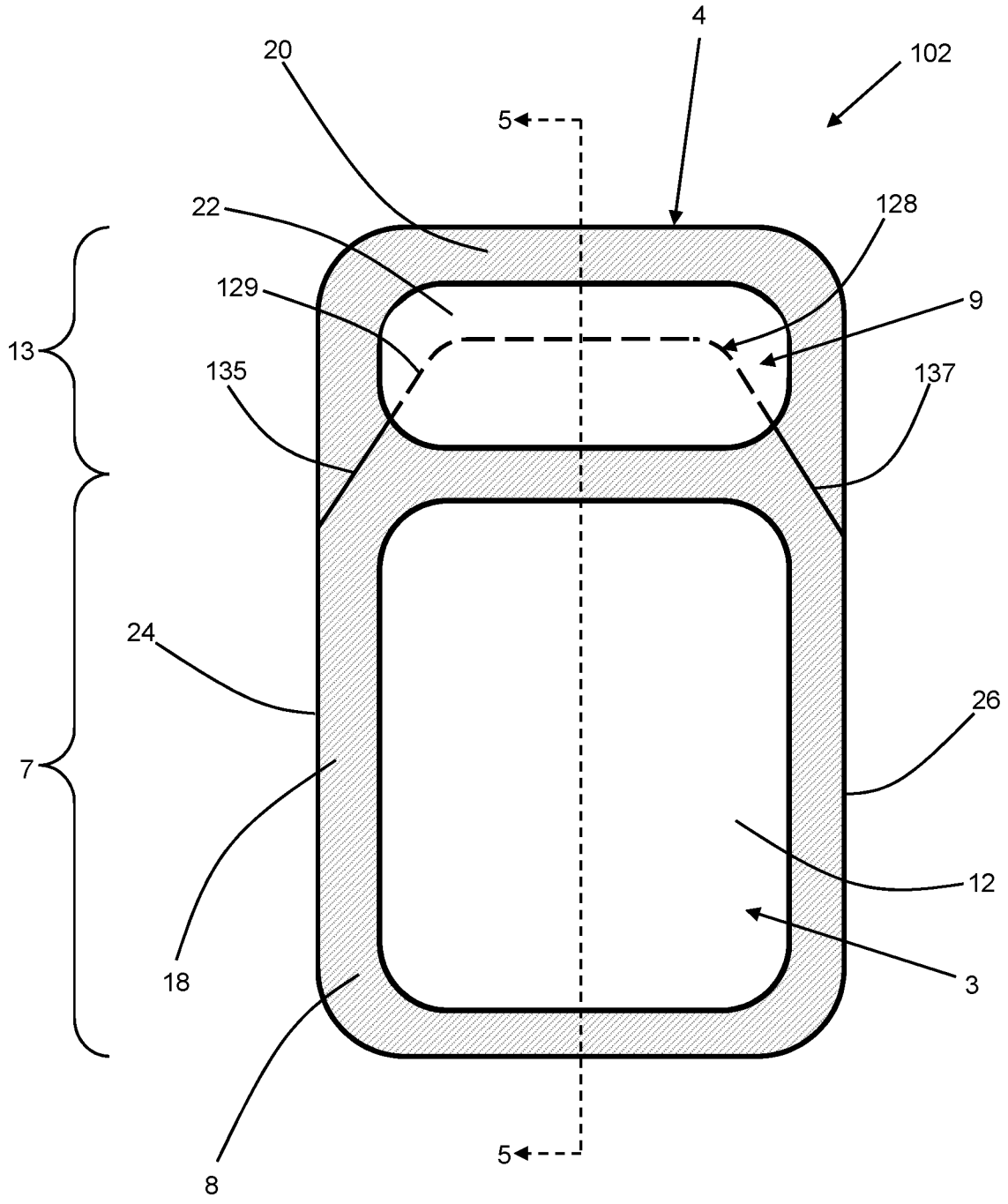
FIG. 5 shows a top view of a packaged aerosol-generating article according to a second embodiment of the present disclosure.
Figure 6:
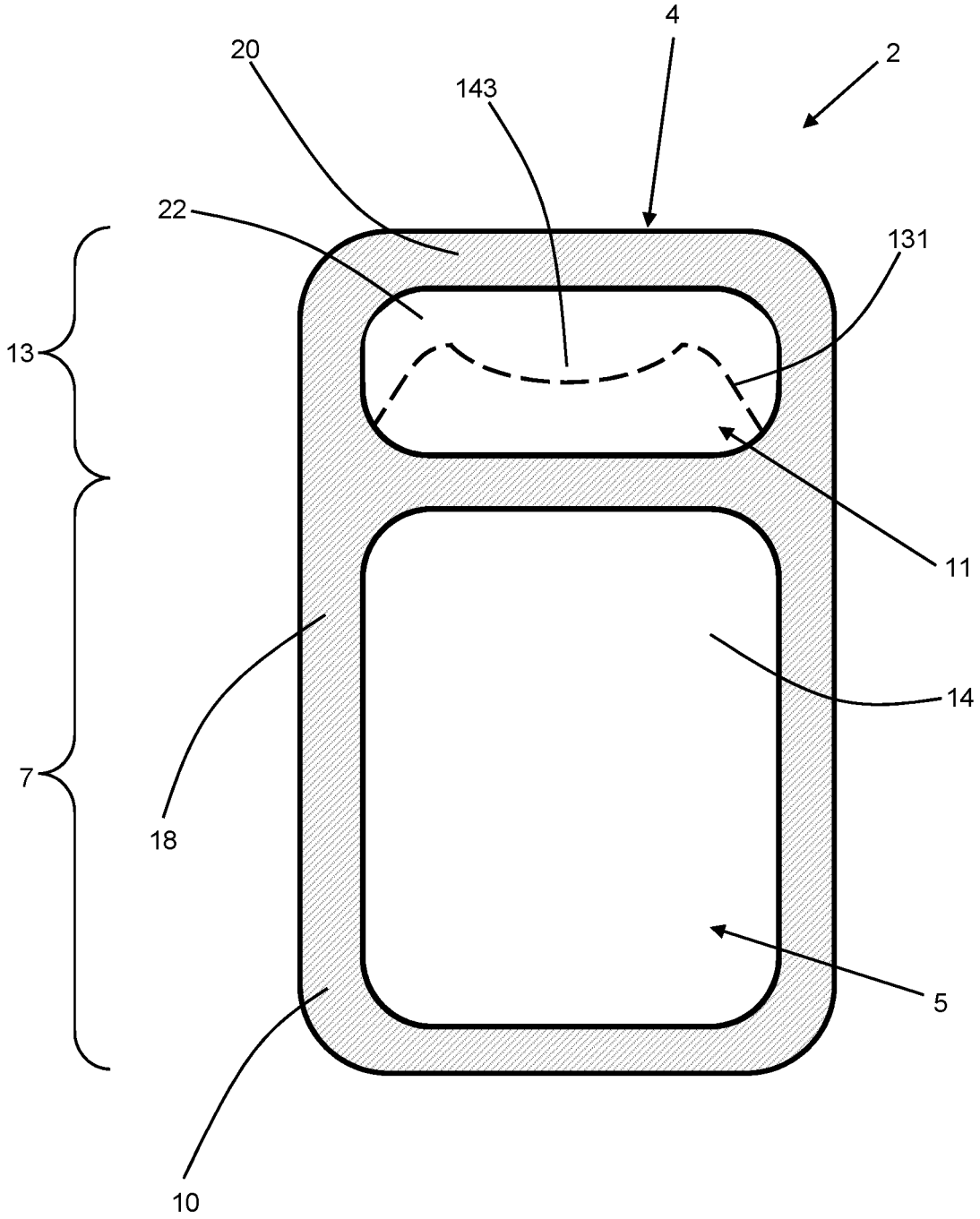
FIG. 6 shows a bottom view of the packaged aerosol-generating article of FIG. 5.
Figure 7:
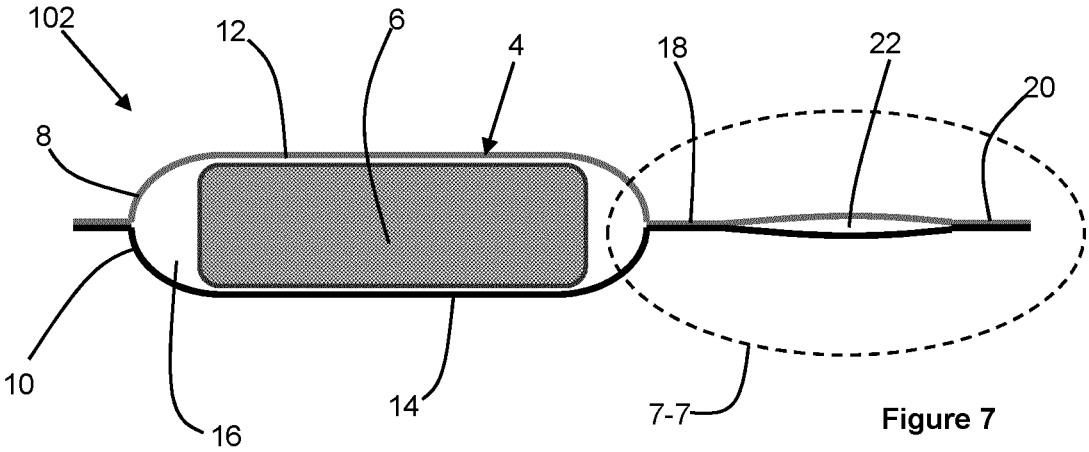
FIG. 7 shows a cross-sectional view of the packaged aerosol-generating article of FIGS. 5 and 6 taken along line 5-5.

Secondly, a user separately grasps the first substrate layer 8 and the second substrate layer 10 at the unsealed area 22 and pulls the first substrate layer 8 and the second substrate layer 10 away from each other to detach the first substrate layer 8 from the second substrate layer 10 at the sealed compartment region perimeter 18. This step is illustrated in FIG. 4. Once the first substrate layer 8 has been detached from the second substrate layer 10 across at least part of the sealed compartment region perimeter 18 the aerosol-generating article 6 may be removed from the compartment 16.

FIGS. 5 to 10 show a packaged aerosol-generating article 102 according to a second embodiment of the present disclosure. The packaged aerosol-generating article 102 is similar to the packaged aerosol-generating article 2 described with reference to FIGS. 1 to 4, and like reference numerals are used to designate like parts.

The packaged aerosol-generating article 102 comprises a container 4 and an aerosol-generating article 6 received within the container 4. The container 4 comprises a first substrate layer 8 and a second substrate layer 10 overlying the first substrate layer 8. Each of the first substrate layer 8 and the second substrate layer 10 is formed from a laminate material comprising a layer of paper forming an outer surface of the substrate layer and a layer of a polymeric film forming an inner surface of the substrate layer.

A first portion 3 of the first substrate layer 8 and a first portion 5 of the second substrate layer 10 form a compartment region 7, wherein a perimeter 18 of the compartment region 7 is completely sealed by a continuous thermal weld to form a sealed compartment 16 in which the aerosol-generating article 6 is positioned. The first portion 3 of the first substrate layer 8 comprises a first recess 12 and the first portion 5 of the second substrate layer 10 comprises a second recess 14, wherein the first recess 12 and the second recess 14 together define the compartment 16.

A second portion 9 of the first substrate layer 8 and a second portion 11 of the second substrate layer 10 form an access region 13 directly adjacent to the compartment region 7, wherein the access region 13 comprises an unsealed area 22 and wherein a perimeter 20 of the access region 13 extends around the unsealed area 22 and is completely sealed. The unsealed area 22 is separated from the sealed compartment 16 by the completely sealed perimeter 18 of the compartment region 7.

A first line of weakness 128 is provided in the first substrate layer 10 and comprises a perforation line 129 extending across part of the unsealed area 22. The first line of weakness 128 also comprises a first cut line 135 extending across the sealed compartment region perimeter 18 between a first end of the perforation line 129 and a first edge 24 of the container 4. The first line of weakness 128 also comprises a second cut line 137 extending across the sealed compartment region perimeter 18 between a second end of the perforation line 129 and a second edge 26 of the container 4.

A second line of weakness 131 comprising a perforation line is provided in the second substrate layer 10 and extends across part of the unsealed area 22. The second line of weakness 131 has a different shape to the first line of weakness 128 so that the second line of weakness 131 only partially overlies the first line of weakness 128. In particular, end portions of the second line of weakness 131 overlie corresponding end portions of the perforation line 129 of the first line of weakness 128. However, a central portion of the second line of weakness 131 is shaped to define a tab 143. The function of the tab 143 is described in further detail below.

Although the first substrate layer 8 is not secured to the second substrate layer 10 at the unsealed area 22, the completely sealed access region perimeter 20 makes it difficult to separate the first substrate layer 8 from the second substrate layer 10. Therefore, the completely sealed access region perimeter 20 reduces the risk of the container 4 being opened accidentally.

Opening of the container 4 to remove the aerosol-generating article 6 from the container 4 is a two-step process.

Figure 8:
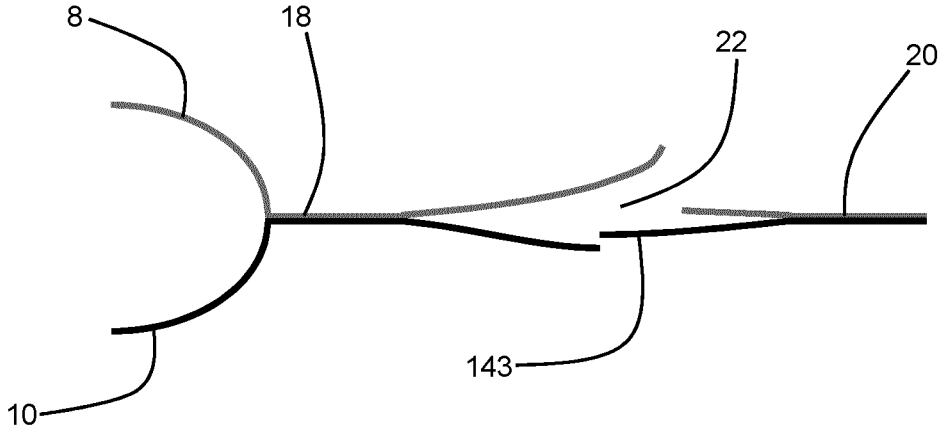
FIGS. 8 to 10 show an enlarged view of the portion of the packaged aerosol-generating article of FIG. 7 circled by line 7-7.

Firstly, a user bends the container 4 to break the first substrate layer 8 along the first line of weakness 128 and to break the second substrate layer 10 along the second line of weakness 131. The outcome of this step is shown in FIG. 8.

Figure 9:
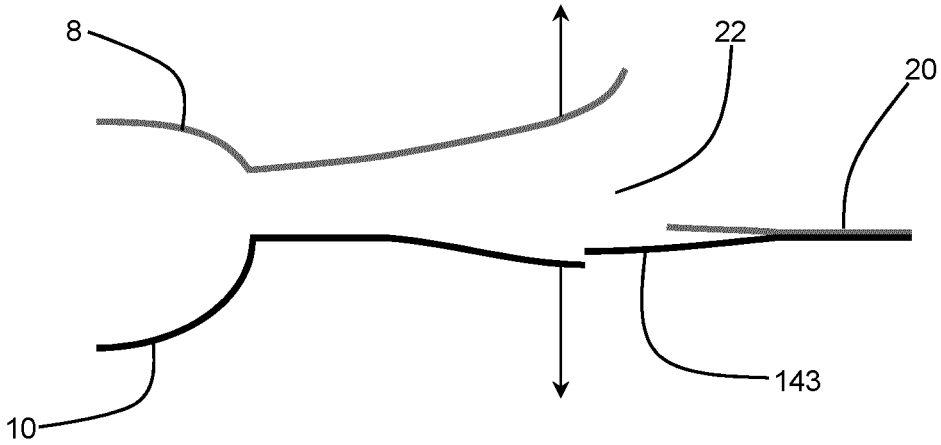

Secondly, a user separately grasps the first substrate layer 8 and the second substrate layer 10 at the unsealed area 22 and pulls the first substrate layer 8 and the second substrate layer 10 away from each other to detach the first substrate layer 8 from the second substrate layer 10 at the sealed compartment region perimeter 18. The first cut line 135 and the second cut line 137 in the first substrate layer 8 facilitate detachment of the first substrate layer 8 from the second substrate layer 10 at the sealed compartment region perimeter 18. This step is illustrated in FIG. 9. Once the first substrate layer 8 has been detached from the second substrate layer 10 across at least part of the sealed compartment region perimeter 18 the aerosol-generating article 6 may be removed from the compartment 16.

Figure 10:
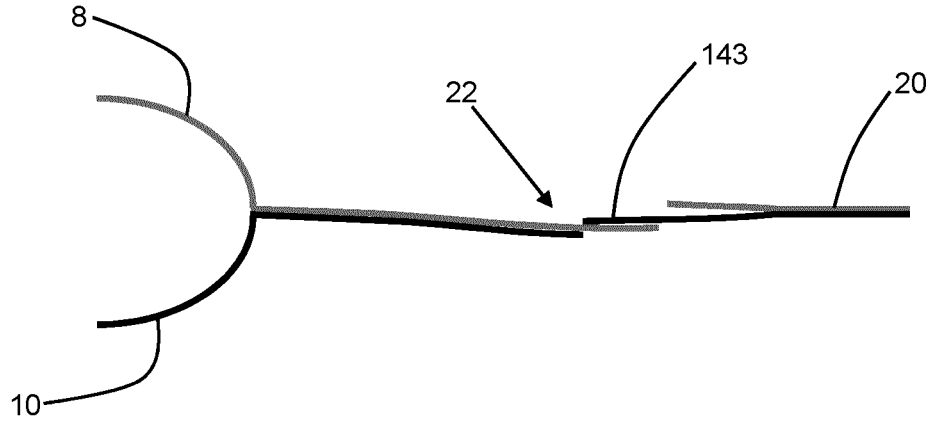

FIG. 10 illustrates the function of the tab 143 formed by the second substrate layer 10 when the second substrate layer 10 is broken along the second line of weakness 131. The tab 143 facilitates reclosing of the container 4 by allowing a user to position part of the first substrate layer 8 at the unsealed area 22 under the tab 143. For example, when the aerosol-generating article 6 has been used, the user may reinsert the aerosol-generating article 6 into the compartment 16 and reclose the container 4 by positioning part of the first substrate layer 8 at the unsealed area 22 under the tab 143. The used aerosol-generating article 6 may then be carried in the container 4 until the user can dispose of the used aerosol-generating article 6 and the container 4 together.

Figure 11:
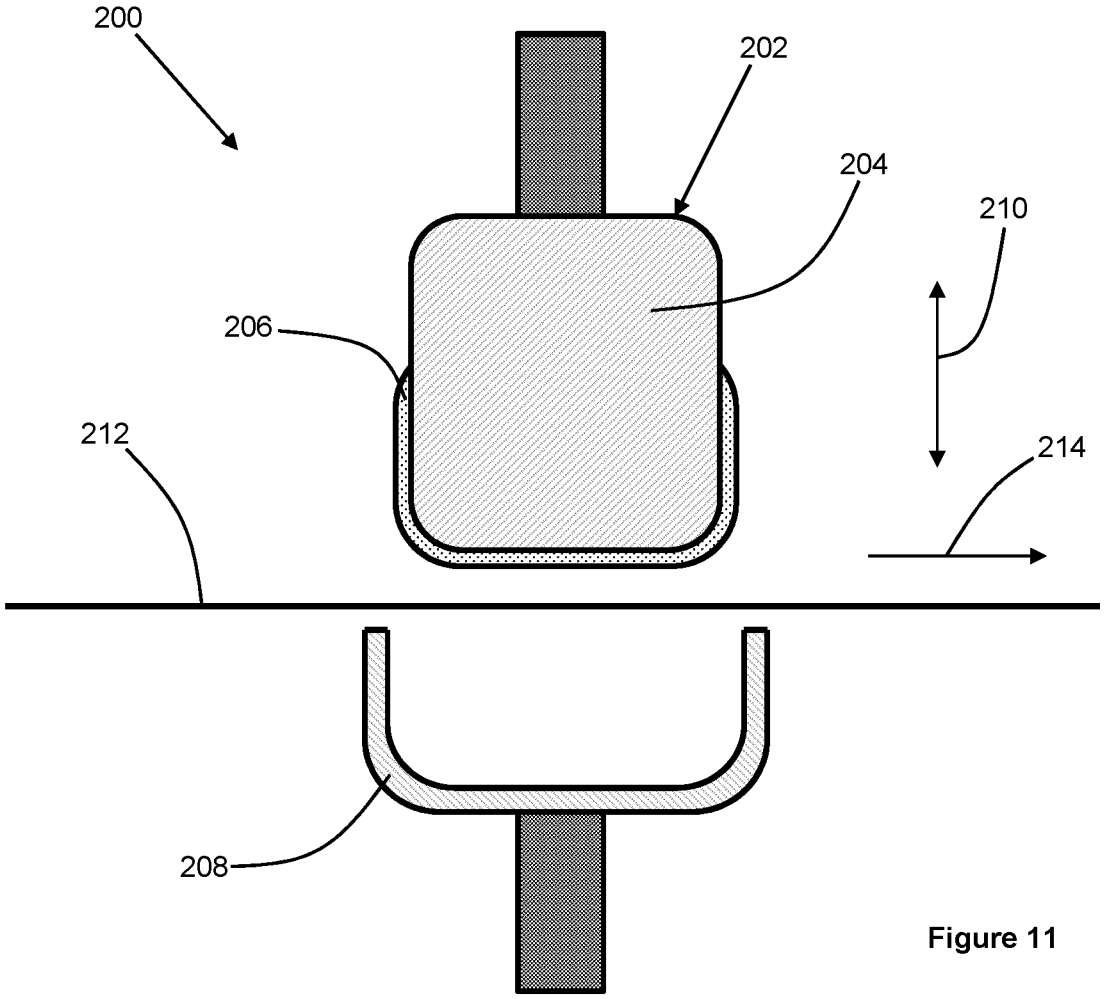
FIGS. 11 to 13 show a plug assist apparatus for thermoforming a recess in a web of substrate material.
Figure 12:
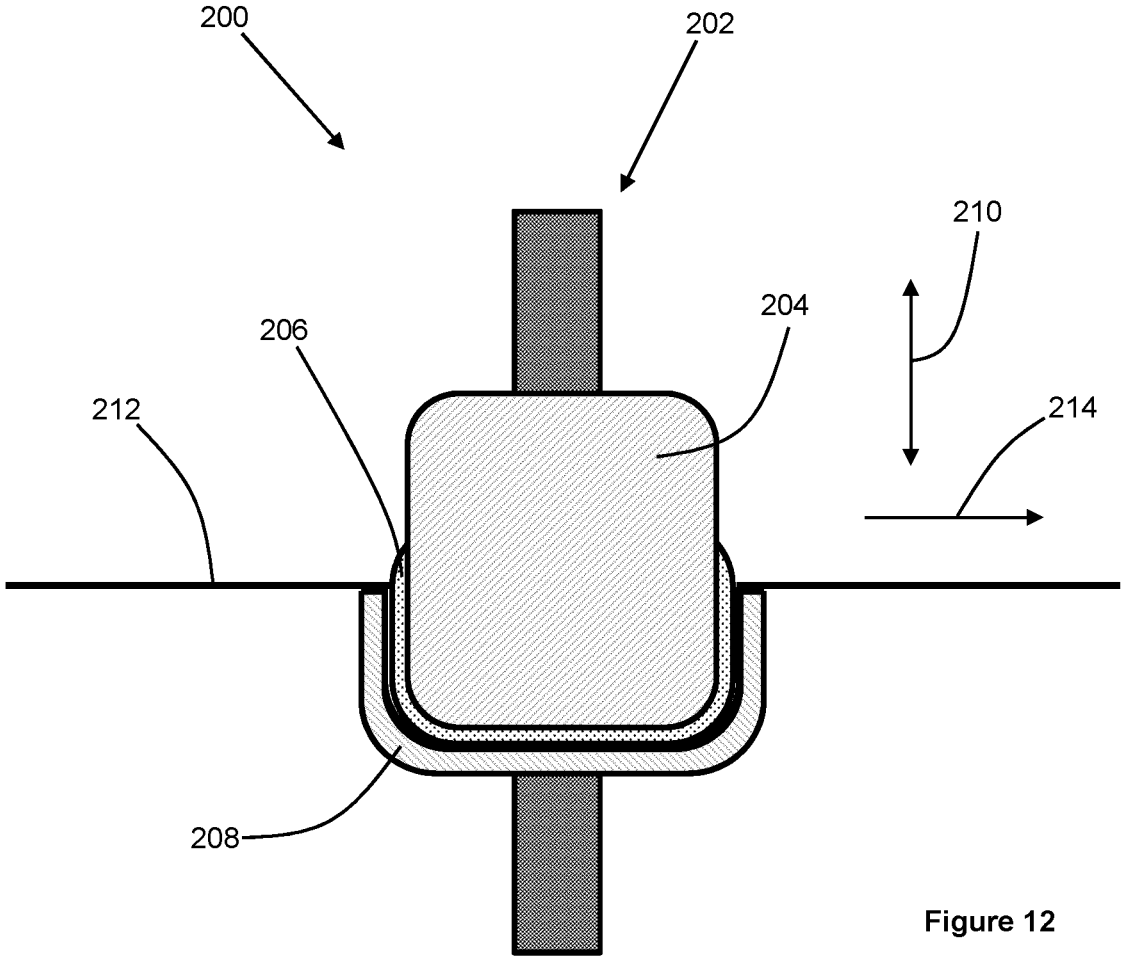
Figure 13:
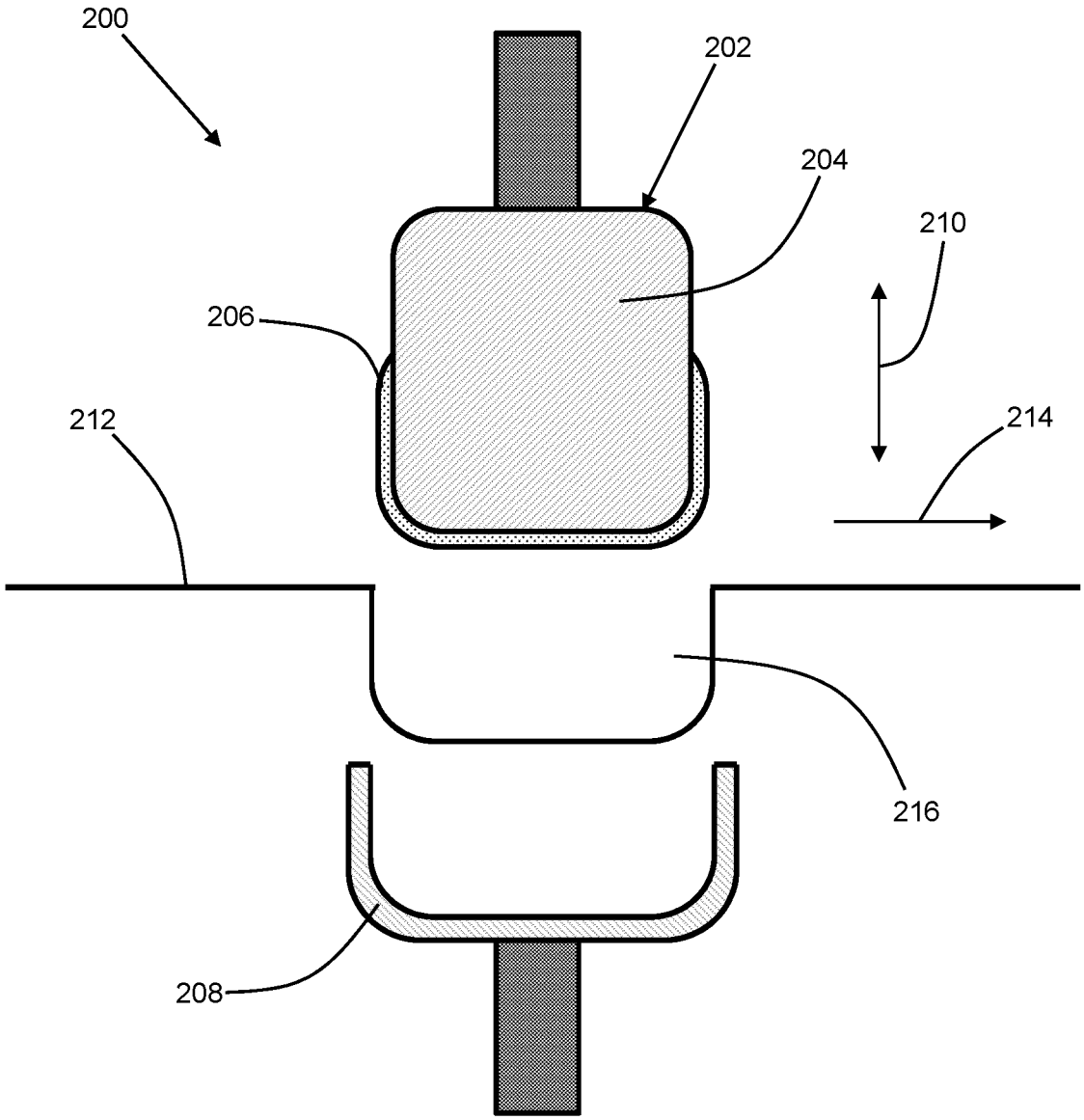

FIGS. 11 to 13 show a plug assist apparatus 200 for thermoforming a recess in a web of substrate material. The plug assist apparatus 200 may be used to thermoform the first recess 12 and the second recess 14 of the first substrate layer 8 and the second substrate layer 10 described with reference to FIGS. 1 to 10.

The plug assist apparatus 200 comprises a plug 202 comprising a plug body 204 formed from stainless steel and an elastomeric cover 206 extending over a portion of the plug body 204. The plug body 204 has a rounded cuboid shape.

The plug assist apparatus 200 also comprises a mold 208 formed from stainless steel and positioned opposite the plug 202. Each of the plug 202 and the mold 208 is arranged for linear movement along a forming direction 210.

In a first configuration shown in FIG. 11 the plug 202 and the mold 208 are spaced apart from each other and a web of substrate material 212 is positioned between the plug 202 and the mold 208. The web of substrate material is arranged for linear movement along a machine direction 214 orthogonal to the forming direction 210.

To form a recess 216 in the web of substrate material 212 the plug 202 and the mold 208 are advanced towards each other along the forming direction 210. The elastomeric cover 206 of the plug 202 engages the web of substrate material 212 and deforms the web of substrate material 212 into the mold 208. The plug 202 and the mold 208 are then withdrawn from the web of substrate material 212 along the forming direction 210 to leave the formed recess 216 in the web of substrate material 212.

Figure 14:
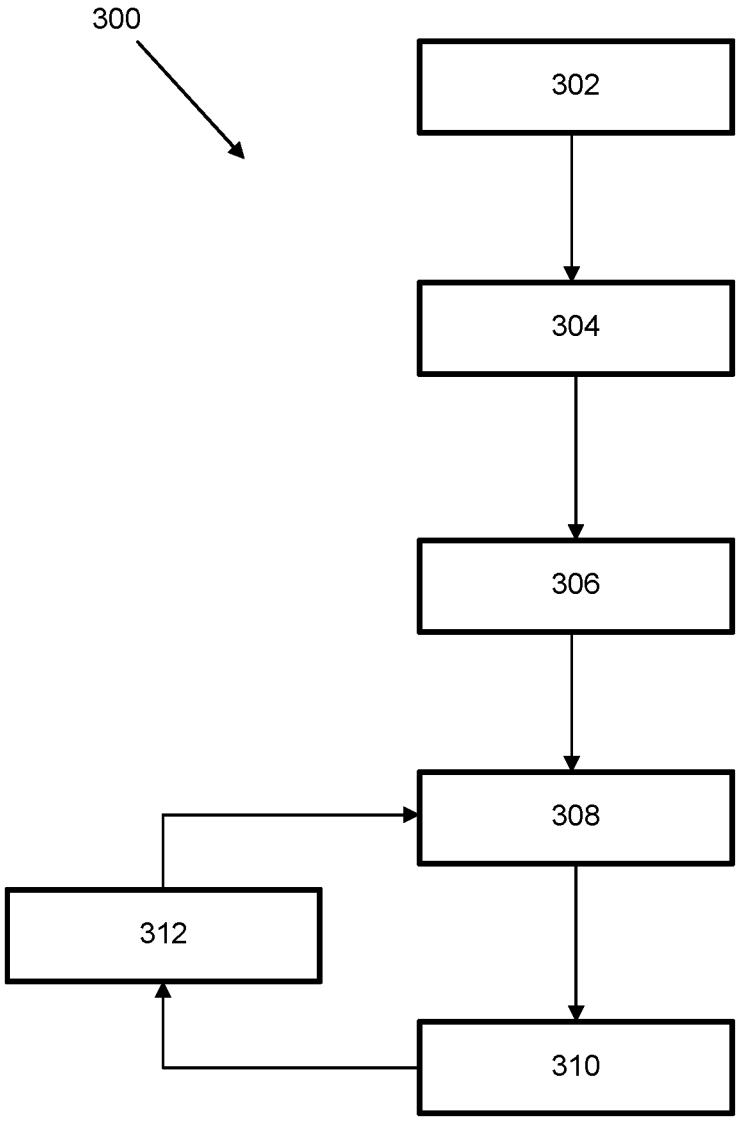
FIG. 14 shows the steps of a plug assist thermoforming process according to an embodiment of the present disclosure.

FIG. 14 shows the steps of a plug assist thermoforming process 300 according to an embodiment of the present disclosure. The process of FIG. 14 is described with reference to the plug assist apparatus 200 of FIGS. 11 to 13, but the skilled person will appreciate that the process may be carried out using any apparatus comprising a mold and a plug comprising a plug body and an elastomeric cover.

The plug assist thermoforming process 300 comprises providing 302 the mold 208 and the plug 202 comprising the plug body 204 and the elastomeric cover 206 extending over a portion of the plug body 204.

The plug assist thermoforming process 300 also comprises heating 304 the web of substrate material 212. The heating step may be carried out by passing the web of substrate material 212 across at least one of a heated roller and a heated plate, impinging heated air or a heated gas on a surface of the web of substrate material, passing the web of substrate material through an oven, and combinations thereof.

The plug assist thermoforming process 300 also comprises positioning 306 the heated web of substrate material 212 between the mold 208 and the plug 202. For example, the heated web of substrate material 212 may be positioned between the mold 208 and the plug 202 by advancing the heated web of substrate material 212 in the machine direction 214.

The plug assist thermoforming process 300 also comprises engaging 308 the elastomeric cover 206 of the plug 202 with the heated web of substrate material 212 and inserting 310 the plug 202 into the mold 208 to form the heated web of substrate material 212 to the shape of the mold 208.

The plug assist thermoforming process 300 may also comprises withdrawing 312 the mold 208 and the plug 202 from the heated web of substrate material 212 and advancing the heated web of substrate material 212 to position a different portion of the heated web of substrate material 212 between the mold 208 and the plug 202. The steps 308, 310 and 312 may be repeated in a loop to form a series of recesses 216 in the heated web of substrate material 212.

Figure 15:
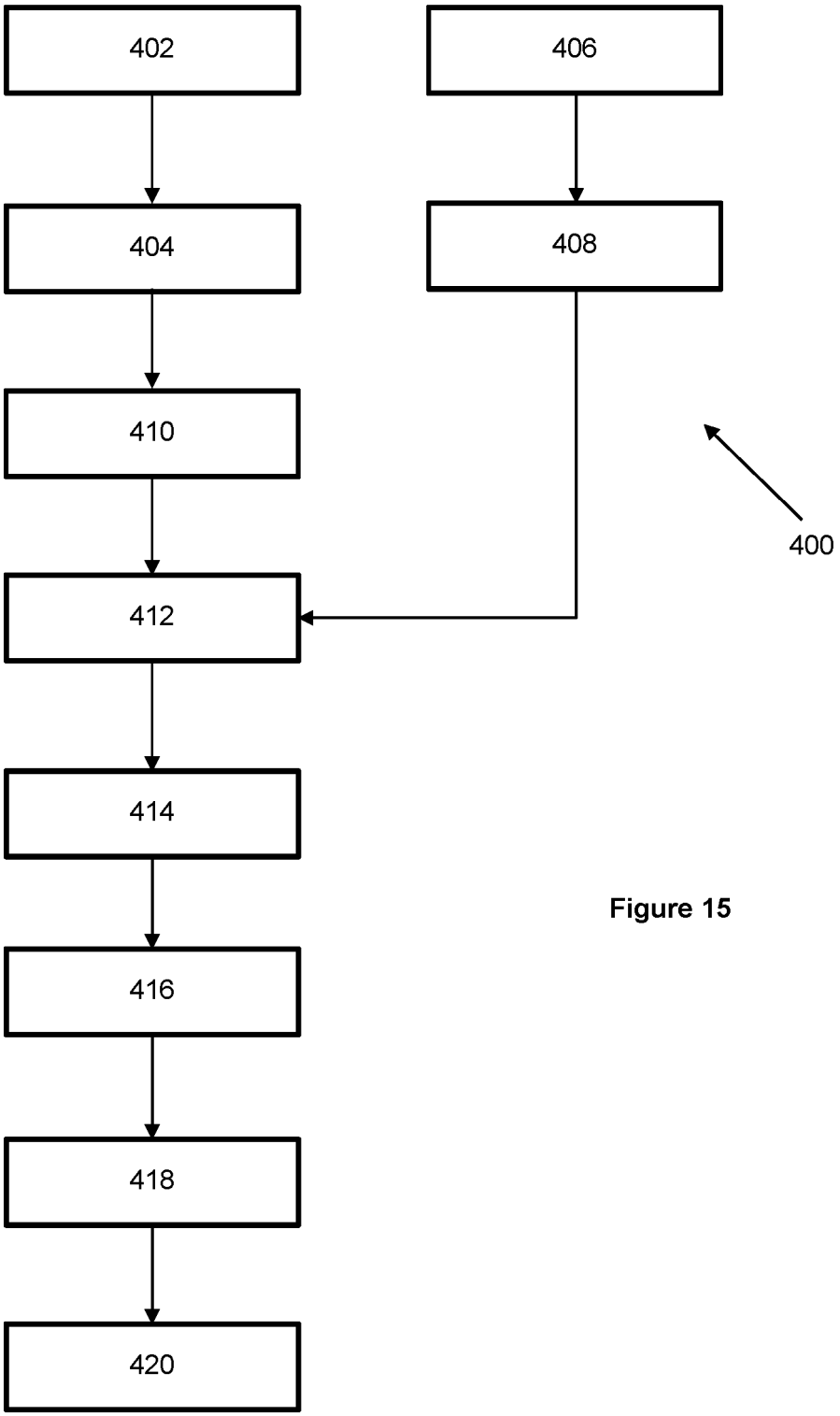
FIG. 15 shows the steps of a method of forming a packaged aerosol-generating article according to an embodiment of the present disclosure.

FIG. 15 shows the steps of a method 400 of forming a packaged aerosol-generating article according to an embodiment of the present disclosure. The packaged aerosol-generating article formed according to the method 400 may be a packaged aerosol-generating article 2 described with reference to FIGS. 1 to 4, a packaged aerosol-generating article 102 described with reference to FIGS. 5 to 10, or a different packaged aerosol-generating article.

The method 400 comprises providing 402 a first web of substrate material and forming 404 a first recess in the first web of substrate material. The step of forming 404 a first recess in the first web of substrate material may be carried out using a plug assist thermoforming process. The plug assist thermoforming process may be the plug assist thermoforming process 300 described with reference to FIG. 14.

The method 400 also comprises providing 406 a second web of substrate material and forming 408 a second recess in the second web of substrate material. The step of forming 408 a second recess in the second web of substrate material may be carried out using a plug assist thermoforming process. The plug assist thermoforming process may be the plug assist thermoforming process 300 described with reference to FIG. 14.

The method 400 also comprises a step of positioning 410 an aerosol-generating article in the first recess of the first web of substrate material.

The method 400 further comprises positioning 412 the second web of substrate material over the aerosol-generating article and the first web of substrate material so that the second recess of the second web of substrate material overlies the aerosol-generating article.

The method 400 also comprises securing 414 a first portion of the first web of substrate material to a first portion of the second web of substrate material to form a compartment region, wherein a perimeter of the compartment region is completely sealed to form a sealed compartment, and wherein the aerosol-generating article is contained within the sealed compartment. The sealed compartment comprises the first recess and the second recess. Preferably, the step of securing 414 the second of web of substrate material to the first web of substrate material is carried out using a thermal weld.

The method 400 also comprises securing 416 a second portion of the first web of substrate material to a second portion of the second web of substrate material to form an access region directly adjacent to the compartment region, wherein the access region comprises an unsealed area, wherein a perimeter of the access region extends around the unsealed area, wherein the first substrate layer is attached to the second substrate layer at the perimeter of the access region, and wherein the unsealed area is separated from the sealed compartment by the completely sealed perimeter of the compartment region. Preferably, the step of securing 416 the second of web of substrate material to the first web of substrate material is carried out using a thermal weld.

It will be appreciated that the step of securing 416 the second web of substrate material to the first web of substrate material to form the access region may be carried out before the step of securing 414 the second web of substrate material to the first web of substrate material to form the compartment region.

It will be appreciated that the step of securing 416 the second web of substrate material to the first web of substrate material to form the access region may be carried out simultaneously with the step of securing 414 the second web of substrate material to the first web of substrate material to form the compartment region.

The method 400 also comprises forming 418 a line of weakness in at least one of the first web of substrate material and the second web of substrate material, wherein the line of weakness extends at least partially within the unsealed area of the access region.

It will be appreciated that the step of forming 418 a line of weakness may be carried out before any of the preceding steps.

The step of forming 418 a line of weakness may comprise forming a first line of weakness in the first web of substrate material and forming a second line of weakness in the second web of substrate material. In embodiments in which the step of forming 418 a line of weakness is carried out before step 412, the method 400 may comprise separate steps of forming a first line of weakness in the first web of substrate material and forming a second line of weakness in the second web of substrate material.

The method 400 also comprises cutting 420 the first web of substrate material and the second web of substrate material to form a packaged aerosol-generating article. The packaged aerosol-generating article comprises the aerosol-generating article and a container comprising a first substrate layer, a second substrate layer, the compartment region, the access region and the line of weakness.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10 percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A container for consumer goods, the container comprising:

a first substrate layer;

a second substrate layer overlying the first substrate layer;

wherein a first portion of the first substrate layer and a first portion of the second substrate layer form a compartment region, wherein a perimeter of the compartment region is completely sealed to form a sealed compartment for containing one or more consumer goods;

wherein a second portion of the first substrate layer and a second portion of the second substrate layer form an access region directly adjacent to the compartment region, wherein the access region comprises an unsealed area, wherein a perimeter of the access region extends around the unsealed area, wherein the first substrate layer is attached to the second substrate layer at the perimeter of the access region, wherein the unsealed area is separated from the sealed compartment by the completely sealed perimeter of the compartment region; and wherein the container further comprises a line of weakness extending at least partially within the unsealed area of the access region, wherein the line of weakness is a first line of weakness in the first substrate layer only, the container further comprising a second line of weakness in the second substrate layer only, wherein the second line of weakness has a different shape to the first line of weakness, wherein the difference in shape between the first line of weakness and the second line of weakness defines a closure tab in the second substrate layer in the unsealed area of the access region, and wherein the difference in shape between the first line of weakness and the second line of weakness is such that a part of the first substrate layer may be tucked underneath the closure tab to retain the first substrate layer in a closed position.

2. A container according to claim 1, wherein the line of weakness extends between a first edge of the container and a second edge of the container.

3. A container according to claim 1, wherein the perimeter of the access region comprises at least one unsealed portion, and wherein the line of weakness extends across the at least one unsealed portion.

4. A container according to claim 3, wherein the at least one unsealed portion comprises a first unsealed portion and a second unsealed portion, wherein a first end of the line of weakness extends across the first unsealed portion and wherein a second end of the line of weakness extends across the second unsealed portion.

5. A container according to claim 1, wherein the line of weakness is linear.

6. A container according to claim 1, wherein at least a portion of the line of weakness is curved.

7. A container according to claim 1, wherein the second line of weakness at least partially overlies the first line of weakness.

8. A container according to claim 1, wherein the first portion of at least one of the first substrate layer and the second substrate layer comprises a recess, and wherein the recess at least partially defines the compartment for containing one or more consumer goods.

9. A container according to claim 1, wherein each of the first substrate layer and the second substrate layer comprises a laminate material, and wherein the laminate material comprises at least one layer of paper and at least one layer of a polymeric film.

10. A packaged aerosol-generating article comprising:

a container according to claim 1; and an aerosol-generating article sealed within the compartment.

11. A method of forming a packaged aerosol-generating article, the method comprising:

providing a first web of substrate material;

positioning an aerosol-generating article on the first web of substrate material;

providing a second web of substrate material;

positioning the second web of substrate material over the aerosol-generating article and the first web of substrate material;

securing a first portion of the first web of substrate material to a first portion of the second web of substrate material to form a compartment region, wherein a perimeter of the compartment region is completely sealed to form a sealed compartment, and wherein the aerosol-generating article is contained within the sealed compartment;

securing a second portion of the first web of substrate material to a second portion of the second web of substrate material to form an access region directly adjacent to the compartment region, wherein the access region comprises an unsealed area, wherein a perimeter of the access region extends around the unsealed area, wherein the first substrate layer is attached to the second substrate layer at the perimeter of the access region, and wherein the unsealed area is separated from the sealed compartment by the completely sealed perimeter of the compartment region;

forming a line of weakness extending at least partially within the unsealed area of the access region, wherein the line of weakness is a first line of weakness in the first substrate layer only, the container further comprising a second line of weakness in the second substrate layer only, wherein the second line of weakness has a different shape to the first line of weakness, wherein the difference in shape between the first line of weakness and the second line of weakness defines a closure tab in the second substrate layer in the unsealed area of the access region, and wherein the difference in shape between the first line of weakness and the second line of weakness is such that a part of the first substrate layer may be tucked underneath the closure tab to retain the first substrate layer in a closed position; and cutting the first web of substrate material and the second web of substrate material to form a packaged aerosol-generating article, the packaged aerosol-generating article comprising the aerosol-generating article and a container comprising a first substrate layer, a second substrate layer, the compartment region, the access region and the line of weakness.

12. A method according to claim 11, wherein each of the first substrate layer and the second substrate layer comprises a laminate material, and wherein the laminate material comprises at least one layer of paper and at least one layer of a polymeric film.

* * * * *